US011503424B2

(12) United States Patent
De Bruijn et al.

(10) Patent No.: US 11,503,424 B2
(45) Date of Patent: Nov. 15, 2022

(54) AUDIO PROCESSING APPARATUS AND METHOD THEREFOR

(71) Applicant: KONINKLIJKE PHILIPS N.V., Eindhoven (NL)

(72) Inventors: Werner Paulus Josephus De Bruijn, Utrecht (NL); Aki Sakari Harma, Eindhoven (NL); Arnoldus Werner Johannes Oomen, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 17/148,666

(22) Filed: Jan. 14, 2021

(65) Prior Publication Data

US 2021/0136512 A1 May 6, 2021

Related U.S. Application Data

(62) Division of application No. 16/788,681, filed on Feb. 12, 2020, now Pat. No. 11,197,120, which is a (Continued)

(30) Foreign Application Priority Data

May 16, 2013 (EP) ..... 13168064

(51) Int. Cl.
*H04S 7/00* (2006.01)
*H04R 5/02* (2006.01)

(52) U.S. Cl.
CPC ..... *H04S 7/308* (2013.01); *H04R 5/02* (2013.01); *H04S 7/302* (2013.01); (Continued)

(58) Field of Classification Search
CPC . G10L 19/008; G10L 19/032; G10L 19/0204; G10L 19/06; G10L 19/22; (Continued)

(56) References Cited

U.S. PATENT DOCUMENTS 8,325,929 B2 * 12/2012 Koppens ..... G10L 19/008 381/1
10,356,356 B2 * 7/2019 Rosella ..... H04N 21/41407
(Continued)

FOREIGN PATENT DOCUMENTS

WO 2013006338 A2 6/2012
WO 2012164444 A1 12/2012
(Continued)

OTHER PUBLICATIONS

Pulkki, "Virtual Sound Source Positioning Using Vector Base Amplitude Panning", J. Audio Eng. Soc., vol. 45, No. 6, 1997, pp. 456-466.

(Continued)

*Primary Examiner* — Alexander Krzystan

(57) ABSTRACT

An audio processing apparatus comprises a receiver (705) which receives audio data including audio components and render configuration data including audio transducer position data for a set of audio transducers (703). A renderer (707) generating audio transducer signals for the set of audio transducers from the audio data. The renderer (7010) is capable of rendering audio components in accordance with a plurality of rendering modes. A render controller (709) selects the rendering modes for the renderer (707) from the plurality of rendering modes based on the audio transducer position data. The renderer (707) can employ different rendering modes for different subsets of the set of audio transducers the render controller (709) can independently select rendering modes for each of the different subsets of the set of audio transducers (703). The render controller (709) can select the rendering mode for a first audio transducer of the set of audio transducers (703) in response to a position of the first audio transducer relative to a predetermined position for the audio transducer. The approach may (Continued)

provide improved adaptation, e.g. to scenarios where most speakers are at desired positions whereas a subset deviate from the desired position(s).

20 Claims, 8 Drawing Sheets

Related U.S. Application Data division of application No. 14/786,567, filed as application No. PCT/EP2014/060109 on May 16, 2014, now Pat. No. 10,582,330.

(52) U.S. Cl.
CPC .... *H04R 2205/024* (2013.01); *H04R 2420/03* (2013.01); *H04S 7/301* (2013.01); *H04S 7/40* (2013.01); *H04S 2400/11* (2013.01); *H04S 2400/15* (2013.01); *H04S 2420/01* (2013.01); *H04S 2420/11* (2013.01); *H04S 2420/13* (2013.01)

(58) Field of Classification Search
CPC ..... H04S 2400/03; H04S 2400/11; H04S 2400/01; H04S 5/005
USPC ..... 381/99, 300, 17, 18, 19, 20, 21, 22, 23; 704/501
See application file for complete search history.

(56) References Cited

U.S. PATENT DOCUMENTS

| | | | | |
|---|---|---|---|---|
| 2007/0041592 | A1 | 2/2007 | Avendano et al. | |
| 2009/0110204 | A1 | 4/2009 | Walsh | |
| 2010/0223552 | A1 | 9/2010 | Metcalf | |
| 2011/0002469 | A1 | 1/2011 | Ojala | |
| 2011/0091055 | A1* | 4/2011 | LeBlanc | H04S 7/301 381/59 |
| 2011/0264456 | A1 | 10/2011 | Koppens | |
| 2013/0101122 | A1 | 4/2013 | Yoo et al. | |
| 2013/0163783 | A1 | 6/2013 | Burlingame | |
| 2013/0236039 | A1 | 9/2013 | Jax | |
| 2014/0114560 | A1 | 4/2014 | Jensen | |
| 2014/0119552 | A1* | 5/2014 | Beaucoup | H04M 9/082 381/66 |
| 2014/0133682 | A1 | 5/2014 | Chabanne | |
| 2014/0169569 | A1 | 6/2014 | Toivanen | |
| 2016/0080886 | A1* | 3/2016 | De Bruijn | H04R 5/02 381/17 |
| 2020/0322743 | A1* | 10/2020 | Cengarle | H04S 3/008 |

FOREIGN PATENT DOCUMENTS

| | | | |
|---|---|---|---|
| WO | 2013006330 | A2 | 1/2013 |
| WO | 2013006342 | A1 | 1/2013 |

OTHER PUBLICATIONS

Van Veen et al, "Beamforming: a Versatile Approach to Spatial Filtering", ASSP Magazine, IEEE Voll 5, Issue 2, 1988, pp. 4-24.
Kirkeby et al, "Design of Cross-Talk Cancellation Networks by Using Fast Deconvolution", AES Convention: 106, Paper No. 4916, 1999, pp. 1-13.
Kirkeby et al, "The 'Stereo Dipole'—A Virtual Source Imaging System Using Two Closely Spaced Loudspeakers", Jael, vol. 46, Issue 5, 1998, pp. 387-395.
Park et al, "A Model of Sound Localisation Applied to the Evaluation of Systems for Stereophony", ACTA Acustica United With Acustica, vol. 94, 2008, pp. 825-839.
Shin et al, "Efficient 3D Sound Field Reproducction", AES Convention: 130, Paper No. 8404, 2011, pp. 1-10.
Daniel et al, "Further Investigations of High Order Ambisonics and Wavefield Synthesis for Holophonic Sound Imaging", AES Convention Paper 5788, 2003, pp. 1-18.

* cited by examiner

AUDIO PROCESSING APPARATUS AND METHOD THEREFOR

CROSS-REFERENCE TO PRIOR APPLICATIONS

This application is a divisional application of U.S. Ser. No. 16/788,681 filed Feb. 12, 2020 which is a divisional application of U.S. Pat. No. 10,582,330 filed Oct. 23, 2015 which is the U.S. National Phase application under 35 U.S.C. § 371 of International Application No. PCT/EP2014/060109, filed on May 6, 2014, which claims the benefit of European Patent Application No. 13168064.7, filed 5 on May 16, 2013. These applications are hereby incorporated by reference herein.

FIELD OF THE INVENTION

The invention relates to an audio processing apparatus and method therefor, and in particular, but not exclusively, to rendering of spatial audio comprising different types of audio components.

BACKGROUND OF THE INVENTION

In recent decades, the variety and flexibility of audio applications has increased immensely with e.g. the variety of audio rendering applications varying substantially. On top of that, the audio rendering setups are used in diverse acoustic environments and for many different applications.

Traditionally, spatial sound reproduction systems have always been developed for one or more specified loudspeaker configurations. As a result, the spatial experience is dependent on how closely the actual loudspeaker configuration used matches the defined nominal configuration, and a high quality spatial experience is typically only achieved for a system that has been set up substantially correctly, i.e. according to the specified loudspeaker configuration.

However, the requirement to use specific loudspeaker configurations with typically a relatively high number of loudspeakers is cumbersome and disadvantageous. Indeed, a significant inconvenience perceived by consumers when deploying e.g. home cinema surround sound systems is the need for a relatively large number of loudspeakers to be positioned at specific locations. Typically, practical surround sound loudspeaker setups will deviate from the ideal setup due to users finding it impractical to position the loudspeakers at the optimal locations. Accordingly the experience, and in particular the spatial experience, which is provided by such setups is suboptimal.

In recent years there has therefore been a strong a trend towards consumers demanding less stringent requirements for the location of their loudspeakers. Even more so, their primary requirement is that the loudspeaker set-up fits their home environment, while at the same time they of course expect the system to still provide a high quality sound experience. These conflicting requirements become more prominent as the number of loudspeakers increases. Furthermore, the issues has become more relevant due to a current trend towards the provision of full three dimensional sound reproduction with sound coming to the listener from multiple directions.

Audio encoding formats have been developed to provide increasingly capable, varied and flexible audio services and in particular audio encoding formats supporting spatial audio services have been developed.

Well known audio coding technologies like DTS and Dolby Digital produce a coded multi-channel audio signal that represents the spatial image as a number of channels placed around the listener at fixed positions. For a loudspeaker setup which is different from the setup that corresponds to the multi-channel signal, the spatial image will be suboptimal. Also, channel based audio coding systems are typically not able to cope with a different number of loudspeakers.

(ISO/IEC) MPEG-2 provides a multi-channel audio coding tool where the bitstream format comprises both a 2 channel and a 5 multichannel mix of the audio signal. When decoding the bitstream with a (ISO/IEC) MPEG-1 decoder, the 2 channel backwards compatible mix is reproduced. When decoding the bitstream with a MPEG-2 decoder, three auxiliary data channels are decoded that when combined (de-matrixed) with the stereo channels result in the 5 channel mix of the audio signal.

(ISO/IEC MPEG-D) MPEG Surround provides a multichannel audio coding tool that allows existing mono- or stereo-based coders to be extended to multi-channel audio applications. FIG. 1 illustrates an example of the elements of an MPEG Surround system. Using spatial parameters obtained by analysis of the original multichannel input, an MPEG Surround decoder can recreate the spatial image by a controlled upmix of the mono- or stereo signal to obtain a multichannel output signal.

Since the spatial image of the multi-channel input signal is parameterized, MPEG Surround allows for decoding of the same multi-channel bit-stream by rendering devices that do not use a multichannel loudspeaker setup. An example is virtual surround reproduction on headphones, which is referred to as the MPEG Surround binaural decoding process. In this mode a realistic surround experience can be provided while using regular headphones. Another example is the pruning of higher order multichannel outputs, e.g. 7.1 channels, to lower order setups, e.g. 5.1 channels.

As mentioned, the variation and flexibility in the rendering configurations used for rendering spatial sound has increased significantly in recent years with more and more reproduction formats becoming available to the mainstream consumer. This requires a flexible representation of audio. Important steps have been taken with the introduction of the MPEG Surround codec. Nevertheless, audio is still produced and transmitted for a specific loudspeaker setup, e.g. an ITU 5.1 loudspeaker setup. Reproduction over different setups and over non-standard (i.e. flexible or user-defined) loudspeaker setups is not specified. Indeed, there is a desire to make audio encoding and representation increasingly independent of specific predetermined and nominal loudspeaker setups. It is increasingly preferred that flexible adaptation to a wide variety of different loudspeaker setups can be performed at the decoder/rendering side.

In order to provide for a more flexible representation of audio, MPEG standardized a format known as 'Spatial Audio Object Coding' (ISO/IEC MPEG-D SAOC). In contrast to multichannel audio coding systems such as DTS, Dolby Digital and MPEG Surround, SAOC provides efficient coding of individual audio objects rather than audio channels. Whereas in MPEG Surround, each loudspeaker channel can be considered to originate from a different mix of sound objects, SAOC allows for interactive manipulation of the location of the individual sound objects in a multi channel mix as illustrated in FIG. 2.

Similarly to MPEG Surround, SAOC also creates a mono or stereo downmix. In addition, object parameters are calculated and included. At the decoder side, the user may manipulate these parameters to control various features of the individual objects, such as position, level, equalization, or even to apply effects such as reverb. FIG. 3 illustrates an interactive interface that enables the user to control the individual objects contained in an SAOC bitstream. By means of a rendering matrix individual sound objects are mapped onto loudspeaker channels. SAOC allows a more flexible approach and in particular allows more rendering based adaptability by transmitting audio objects in addition to only reproduction channels. This allows the decoder-side to place the audio objects at arbitrary positions in space, provided that the space is adequately covered by loudspeakers. This way there is no relation between the transmitted audio and the reproduction or rendering setup, hence arbitrary loudspeaker setups can be used. This is advantageous for e.g. home cinema setups in a typical living room, where the loudspeakers are almost never at the intended positions. In SAOC, it is decided at the decoder side where the objects are placed in the sound scene (e.g. by means of an interface as illustrated in FIG. 3), which is often not desired from an artistic point-of-view. The SAOC standard does provide ways to transmit a default rendering matrix in the bitstream, eliminating the decoder responsibility. However the provided methods rely on either fixed reproduction setups or on unspecified syntax. Thus SAOC does not provide normative means to fully transmit an audio scene independently of the loudspeaker setup. Also, SAOC is not well equipped to the faithful rendering of diffuse signal components. Although there is the possibility to include a so called Multichannel Background Object (MBO) to capture the diffuse sound, this object is tied to one specific loudspeaker configuration.

Another specification for an audio format for 3D audio has been developed by DTS Inc. (Digital Theater Systems). DTS, Inc. has developed Multi-Dimensional Audio (MDA™) an open object-based audio creation and authoring platform to accelerate next-generation content creation. The MDA platform supports both channel and audio objects and adapts to any speaker quantity and configuration. The MDA format allows the transmission of a legacy multichannel downmix along with individual sound objects. In addition, object positioning data is included. The principle of generating an MDA audio stream is illustrated in FIG. 4. In the MDA approach, the sound objects are received separately in the extension stream and these may be extracted from the multi-channel downmix. The resulting multi-channel downmix is rendered together with the individually available objects.

The objects may consist of so called stems. These stems are basically grouped (downmixed) tracks or objects. Hence, an object may consist of multiple sub-objects packed into a stem. In MDA, a multichannel reference mix can be transmitted with a selection of audio objects. MDA transmits the 3D positional data for each object. The objects can then be extracted using the 3D positional data. Alternatively, the inverse mix-matrix may be transmitted, describing the relation between the objects and the reference mix.

From the MDA description, sound-scene information is likely transmitted by assigning an angle and distance to each object, indicating where the object should be placed relative to e.g. the default forward direction. Thus, positional information is transmitted for each object. This is useful for point-sources but fails to describe wide sources (like e.g. a choir or applause) or diffuse sound fields (such as ambiance). When all point-sources are extracted from the reference mix, an ambient multichannel mix remains. Similar to SAOC, the residual in MDA is fixed to a specific loudspeaker setup.

Thus, both the SAOC and MDA approaches incorporate the transmission of individual audio objects that can be individually manipulated at the decoder side. A difference between the two approaches is that SAOC provides information on the audio objects by providing parameters characterizing the objects relative to the downmix (i.e. such that the audio objects are generated from the downmix at the decoder side) whereas MDA provides audio objects as full and separate audio objects (i.e. that can be generated independently from the downmix at the decoder side). For both approaches, position data may be communicated for the audio objects.

Currently, within the ISO/IEC MPEG, a standard MPEG 3D Audio is being prepared to facilitate the transport and rendering of 3D audio. MPEG-3D Audio is intended to become part of the MPEG-H suite along with HEVC video coding and MMT (MPEG Media Transport) systems layer. FIG. 5 illustrates the current high level block diagram of the intended MPEG 3D Audio system.

In addition to the traditional channel based format, the approach is intended to also support object based and scene based formats. An important aspect of the system is that its quality should scale to transparency for increasing bitrate, i.e. that as the data rate increases the degradation caused by the encoding and decoding should continue to reduce until it is insignificant. However, such a requirement tends to be problematic for parametric coding techniques that have been used quite heavily in the past (viz. HE-AAC v2, MPEG Surround, SAOC, USAC). In particular, the compensation of information loss for the individual signals tends to not be fully compensated by the parametric data even at very high bit rates. Indeed, the quality will be limited by the intrinsic quality of the parametric model.

MPEG-3D Audio furthermore seeks to provide a resulting bitstream which is independent of the reproduction setup. Envisioned reproduction possibilities include flexible loudspeaker setups up to 22.2 channels, as well as virtual surround over headphones and closely spaced loudspeakers.

US2013/101122 A1 discloses an object based audio contents generating/playing apparatus enabling the object based audio contents to be played using at least one of a WFS scheme and a multi-channel surround scheme regardless of a reproducing environment of the audience.

WO2013/006338 A2 discloses a system that includes a new speaker layout (channel configuration) and an associated spatial description format. WO2013/006338 A2 aims to provide an adaptive audio system and format that supports multiple rendering technologies. Audio streams are transmitted along with metadata that describes the "mixer's intent" including desired position of the audio object(s).

US2010/223552 A1 discloses a system configured to capture and/or produce a sound event generated by a plurality of sound sources. In particular, the system may be configured such that the capture, processing, and/or output for sound production of sound objects associated with separate once of the sound sources may be controlled on an individual bases.

In summary, the majority of existing sound reproduction systems only allow for a modest amount of flexibility in terms of loudspeaker set-up. Because almost every existing system has been developed from certain basic assumptions regarding either the general configuration of the loudspeakers (e.g. loudspeakers positioned more or less equidistantly around the listener, or loudspeakers arranged on a line in front of the listener, or headphones), or regarding the nature of the content (e.g. consisting of a small number of separate localizable sources, or consisting of a highly diffuse sound scene), every system is only able to deliver an optimal experience for a limited range of loudspeaker configurations that may occur in the rendering environment (such as in a user's home). A new class of sound rendering systems that allow a flexible loudspeaker set-up is therefore desired. This flexibility can comprise various elements including not only the positions of the loudspeakers, but also the number of loudspeakers and their individual characteristics (e.g. bandwidth, maximum output power, directionality, etc.).

Hence, an improved audio rendering approach would be advantageous and in particular an approach allowing increased flexibility, facilitated implementation and/or operation, allowing a more flexible positioning of loudspeakers, improved adaptation to different loudspeaker configurations and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an audio processing apparatus comprising: a receiver for receiving audio data and render configuration data, the audio data comprising audio data for a plurality of audio components and the render configuration data comprising audio transducer position data for a set of audio transducers; a renderer for generating audio transducer signals for the set of audio transducers from the audio data, the renderer being capable of rendering audio components in accordance with a plurality of rendering modes; a render controller arranged to select rendering modes for the renderer out of the plurality of rendering modes in response the audio transducer position data; and wherein the renderer is arranged to employ different rendering modes for different subsets of the set of audio transducers, and to independently select rendering modes for each of the different subsets of the set of audio transducers, and wherein the render controller is arranged to select the rendering mode for a first audio transducer of the set of audio transducers in response to a position of the first audio transducer relative to a predetermined position for the first audio transducer, and to select a default rendering mode for the first audio transducer unless a difference between the position of the first audio transducer and the predetermined position exceeds a threshold.

The invention may provide improved rendering in many scenarios. In many practical applications, a substantially improved user experience may be achieved. The approach allows for increased flexibility and freedom in positioning of audio transducers (specifically loudspeakers) used for rendering audio. For example, the approach may allow improved adaptation and optimization for audio transducers not positioned optimally (e.g. in accordance with a predetermined or default configuration setup) while at the same allowing audio transducers positioned substantially optimally to be fully exploited.

The different audio components may specifically all be part of the same sound stage or audio scene. The audio components may be spatial audio components, e.g. by having associated implicit position information or explicit position information, e.g. provided by associated meta-data. The rendering modes may be spatial rendering modes.

The audio transducer signals may be drive signals for the audio transducers. The audio transducer signals may be further processed before being fed to the audio transducers, e.g. by filtering or amplification. Equivalently, the audio transducers may be active transducers including functionality for amplifying and/or filtering the provided drive signal. An audio transducer signal may be generated for each audio transducer of the plurality of audio transducers.

The render controller may be arranged to independently select the rendering mode for the different subsets in the sense that different rendering modes may be selected for the subsets. The selection of a rendering mode for one subset may consider characteristics associated with audio transducers belonging to the other subset.

The audio transducer position data may provide a position indication for each audio transducer of the set of audio transducers or may provide position indications for only a subset thereof.

The renderer may be arranged to generate, for each audio component, audio transducer signal components for the audio transducers, and to generate the audio transducer signal for each audio transducer by combing the audio transducer signal components for the plurality of audio components.

In accordance with an optional feature of the invention, the renderer is operable to employ different rendering modes for audio objects for a first audio transducer of the set of transducers, and the render controller is arranged to independently select rendering modes for each of the audio objects for the first audio transducer.

This may provide improved performance in many embodiments and/or may allow an improved user experience and/or increased freedom and flexibility. In particular, the approach may allow improved adaptation to the specific rendering scenario wherein optimization to both the specific rendering configuration and the audio being rendered is considered. In particular, the subsets of audio transducers for which a specific rendering algorithm is used may be different for different audio components to reflect the different characteristics of the audio components.

In some embodiments, the render controller may be arranged to select, for a first audio component, a selected rendering mode from the plurality of rendering modes in response to the render configuration data; and to determine a set of rendering parameters for the selected rendering mode in response to the audio description data.

In accordance with an optional feature of the invention, at least two of the plurality of audio components are different audio types.

This may provide improved performance in many embodiments and/or may allow an improved user experience and/or increased freedom and flexibility. In particular, the approach may allow improved adaptation to the specific rendering scenario wherein optimization to both the specific rendering configuration and the audio being rendered is performed.

The rendering mode used for a given audio transducer may be different for different audio components. The different rendering modes may be selected depending on the audio type of the audio components. The audio description data may indicate the audio type of one or more of the plurality of audio components.

In accordance with an optional feature of the invention, the plurality of audio components comprises at least two audio components of different audio types from the group consisting of: audio channel components, audio object components, and audio scene components; and the renderer is arranged to use different rendering modes for the at least two audio components.

This may provide particularly advantageous performance and may in particular allow improved performance for systems such as MPEG 3D Audio. The render controller may select the rendering mode for a given subset of audio transducers and a first audio component depending on whether the audio component is an audio channel, audio object or audio scene object.

The audio components may specifically be audio channel components, audio object components and/or audio scene components in accordance with MPEG standard ISO/IEC 23008-3 MPEG 3D Audio.

In accordance with an optional feature of the invention, the receiver is arranged to receive audio type indication data indicative of an audio type of at least a first audio component, and the render controller is arranged to select the rendering mode for the first audio component in response to the audio type indication data.

This may provide improved performance and may allow an improved user experience, improved adaptation, and/or improved flexibility and freedom in audio transducer positioning.

The render controller is arranged to select the rendering mode for a first audio transducer in response to a position of the first audio transducer relative to a predetermined position for the audio transducer.

This may provide improved performance and may allow an improved user experience, improved adaptation, and/or improved flexibility and freedom in audio transducer positioning.

The position of the first audio transducer and/or the predetermined position may be provided as an absolute position or as a relative position, e.g. relative to a listening position.

The predetermined position may be a nominal or default position for an audio transducer in a rendering configuration. The rendering configuration may be a rendering configuration associated with a standard setup, such as for example a nominal 5.1 surround sound loudspeaker setup. The rendering configuration may in some situations correspond to a default rendering configuration associated with one or more of the audio components, such as e.g. a rendering configuration associated with audio channels. Specifically, the predetermined position may be a default audio transducer position assumed or defined for an audio channel.

The render controller is arranged to select a default rendering mode for the first audio transducer unless a difference between the position of the first audio transducer and the predetermined position exceeds a threshold.

This may facilitate operation and may in many embodiments and scenario allow improved reliability and/or robustness. The default rendering mode may for example be associated with a default rendering configuration (such as a surround sound rendering algorithm associated with a standard surround sound audio transducer configuration). The default rendering mode (e.g. the surround sound rendering mode) may be used for audio transducers that are positioned close to the default positions of the standard surround sound audio transducer configuration, whereas an alternative rendering mode/algorithm may be selected when the audio transducer position deviates sufficiently from the default position.

In accordance with an optional feature of the invention, the render controller is arranged to divide the set of audio transducers into a first subset of audio transducers comprising audio transducers for which a difference between the position of the audio transducer and the predetermined position exceeds a threshold and a second subset of audio transducers comprising at least one audio transducer for which a difference between the position of the audio transducer and the predetermined position does not exceed a threshold; and to select a rendering mode for each audio transducer of the first subset from a first rendering mode subset and to select a rendering mode for each audio transducer of the second subset from a second rendering mode subset.

The approach may provide facilitated operation and/or improved performance and/or increased flexibility.

The first subset may include audio transducers which are positioned far from the default position of a given nominal rendering/audio transducer configuration. The second subset may include one or more audio transducers that are positioned close to the default position of the given nominal rendering/audio transducer configuration. The drive signal(s) for the second subset may use a nominal rendering mode associated with the given nominal rendering/audio transducer configuration, whereas the drive signals for the first subset may use a different rendering mode compensating for the audio transducers not being at the default positions. The first subset may possibly include one or more audio transducers for which the difference between the position of the audio transducer and the predetermined position does not exceed a threshold; for example if such audio transducer(s) are used to support the rendering from the audio transducers for which the difference does exceed a threshold.

In accordance with an optional feature of the invention, the plurality of rendering modes includes at least one rendering mode selected from the group consisting of: a stereophonic rendering; a vector base amplitude panning rendering; a beamform rendering; a cross-talk cancellation rendering; an ambisonic rendering; a wave field synthesis rendering; and a least squares optimized rendering.

The individual selection for audio transducer subsets between these rendering modes provides a particularly advantageous performance. Indeed, the rendering modes of the group have characteristics that are particularly appropriate to different rendering/audio transducer configurations with different characteristics.

In accordance with an optional feature of the invention, the receiver is further arranged to receive rendering position data for the audio components, and the render controller is arranged to select the rendering modes in response to the rendering position data.

This may provide improved performance and adaptation, and will in many embodiments and scenarios allow an improved user experience.

In accordance with an optional feature of the invention, the renderer is arranged to employ different rendering modes for different frequency bands of an audio component of the audio components; and the render controller is arranged to independently select rendering modes for different frequency bands of the audio component.

This may provide improved performance and adaptation, and will in many embodiments and scenarios allow an improved user experience.

In accordance with an optional feature of the invention, the render controller is arranged to synchronize a change of rendering for at least one audio component to an audio content change in the at least one audio component.

This may provide improved performance and adaptation, and will in many embodiments and scenarios allow an improved user experience. It may in particular reduce the noticeability of changes in the rendering to the user.

In accordance with an optional feature of the invention, the render controller is further arranged to select the rendering modes in response to render configuration data from the group consisting of: audio transducer position data for audio transducers not in the set of audio transducers, listening position data; audio transducer audio rendering characteristics data for audio transducers of the set of audio transducers; and user rendering preferences.

This may provide improved performance and adaptation, and will in many embodiments and scenarios allow an improved user experience.

In accordance with an optional feature of the invention, the render controller is arranged to select the rendering mode in response to a quality metric generated by a perceptual model.

This may provide particularly advantageous operation and may provide improved performance and/or adaptation. In particular, it may allow efficient and optimized adaptation in many embodiments.

According to an aspect of the invention there is provided a method of audio processing, the method comprising: receiving audio data and render configuration data, the audio data comprising audio data for a plurality of audio components and the render configuration data comprising audio transducer position data for a set of audio transducers; generating audio transducer signals for the set of audio transducers from the audio data, the generation comprising rendering audio components in accordance with rendering modes of a plurality of possible rendering modes; selecting rendering modes for the renderer out of the plurality of possible rendering modes in response the audio transducer position data; and wherein generation of audio transducer signals comprises employing different rendering modes for different subsets of the set of audio transducers, and independently selecting rendering modes for each of the different subsets of the set of audio transducers, and wherein selecting rendering modes for the renderer comprises selecting a rendering mode for a first audio transducer of the set of transducers in response to a position of the first audio transducer relative to a predetermined position for the first audio transducer, and select a default rendering mode for the first audio transducer unless a difference between the position of the first audio transducer and the predetermined position exceeds a threshold.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
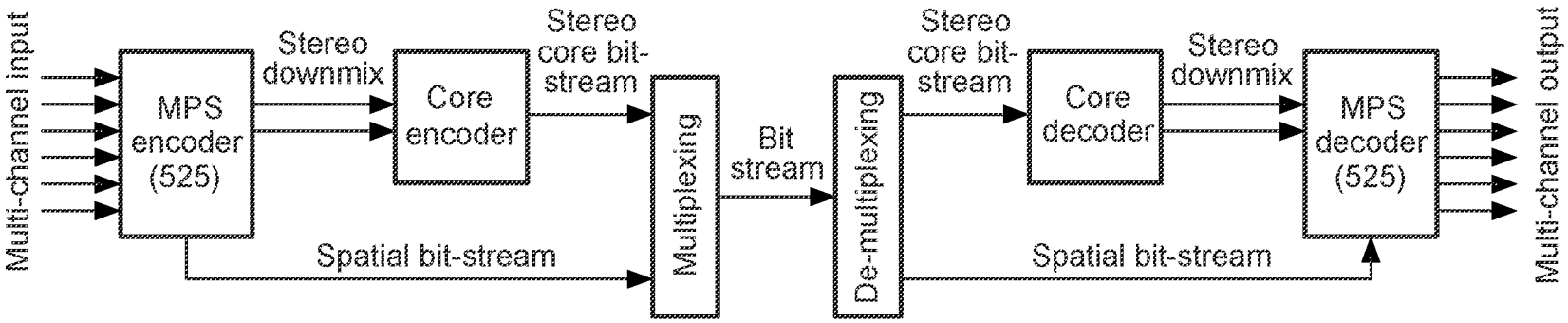
FIG. 1 illustrates an example of the principle of an MPEG Surround system in accordance with prior art.
Figure 2:
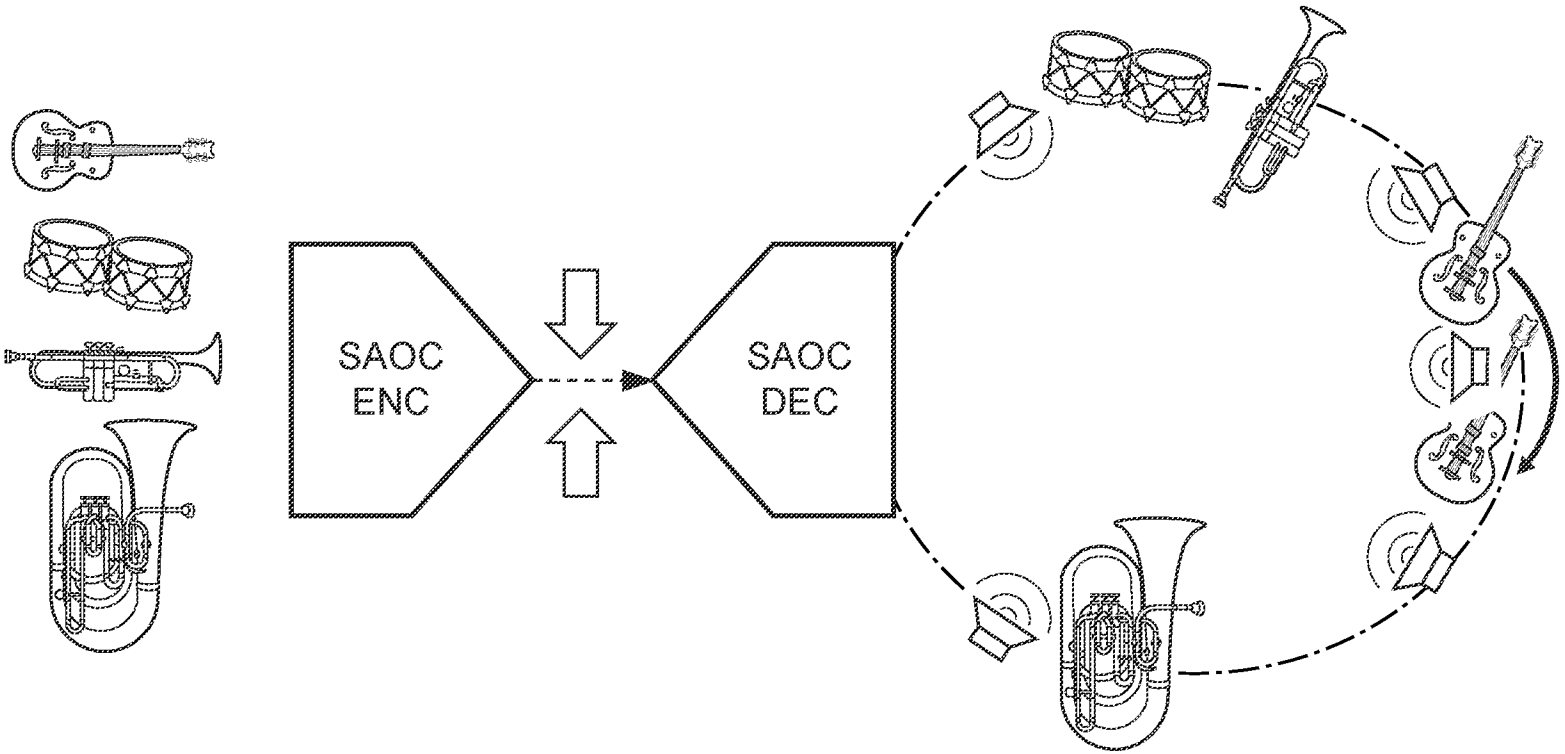
FIG. 2 illustrates an example of elements of an SAOC system in accordance with prior art.
Figure 3:
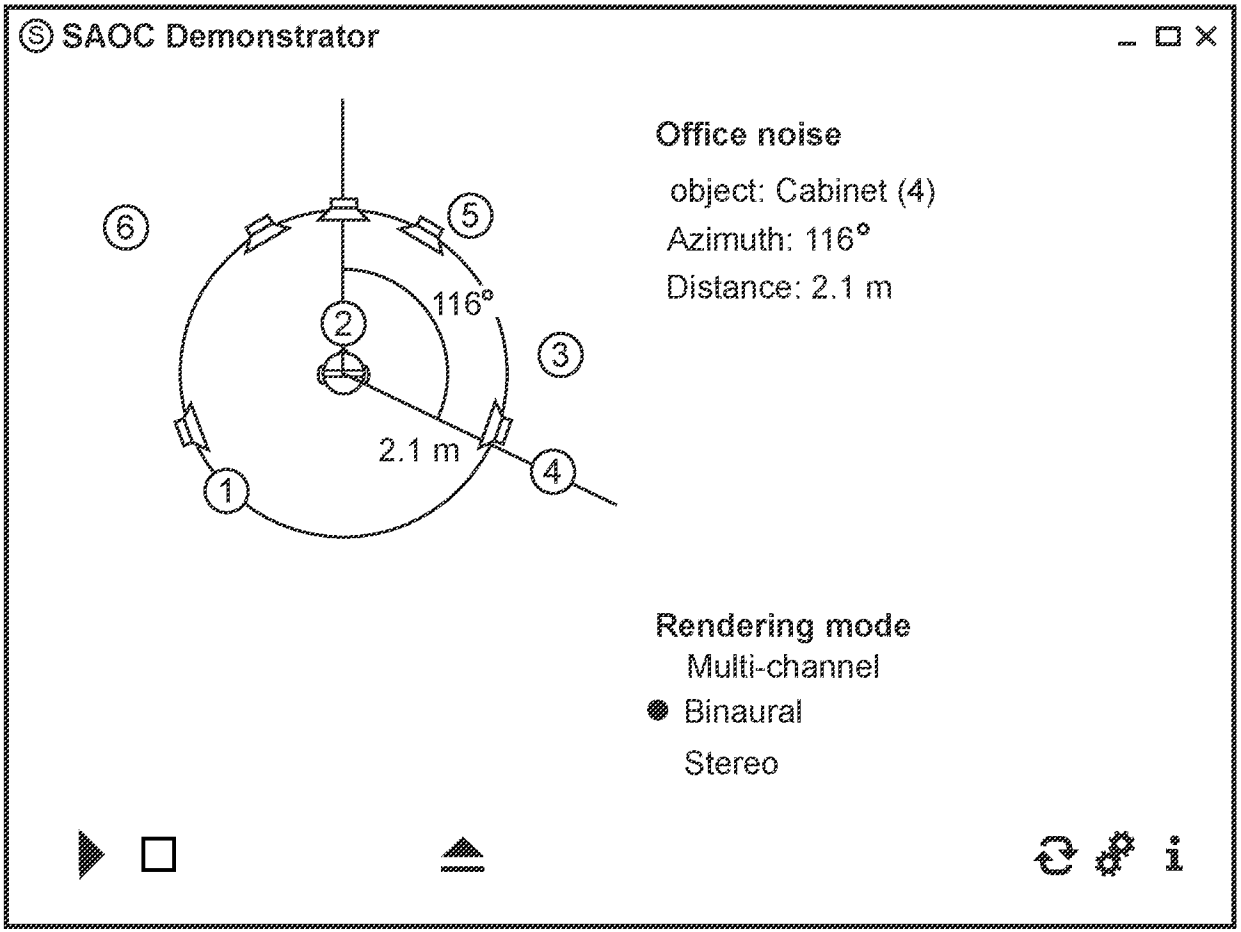
FIG. 3 illustrates an interactive interface that enables the user to control the individual objects contained in a SAOC bitstream.
Figure 4:
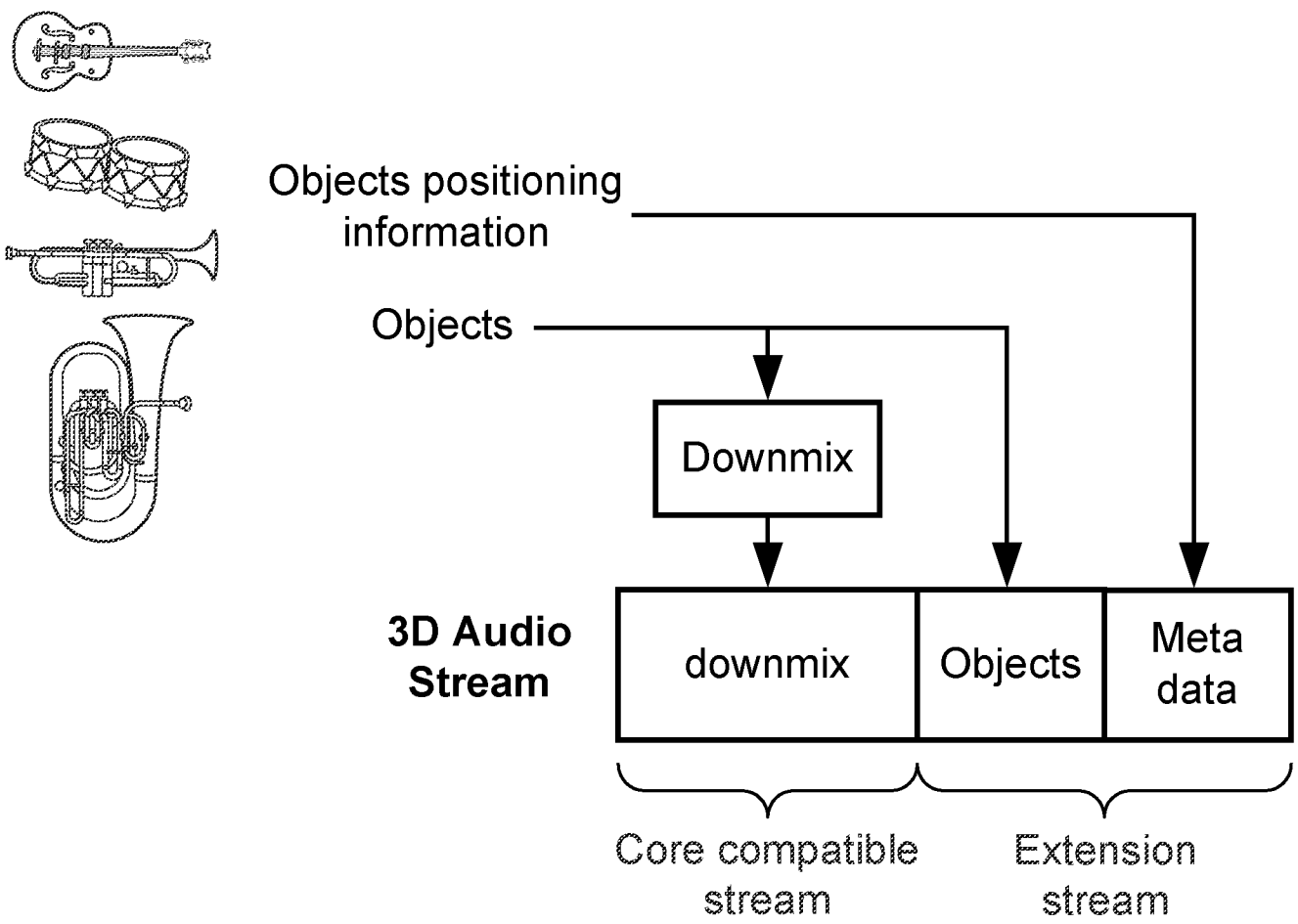
FIG. 4 illustrates an example of the principle of audio encoding of DTS MDA™ in accordance with prior art.
Figure 5:
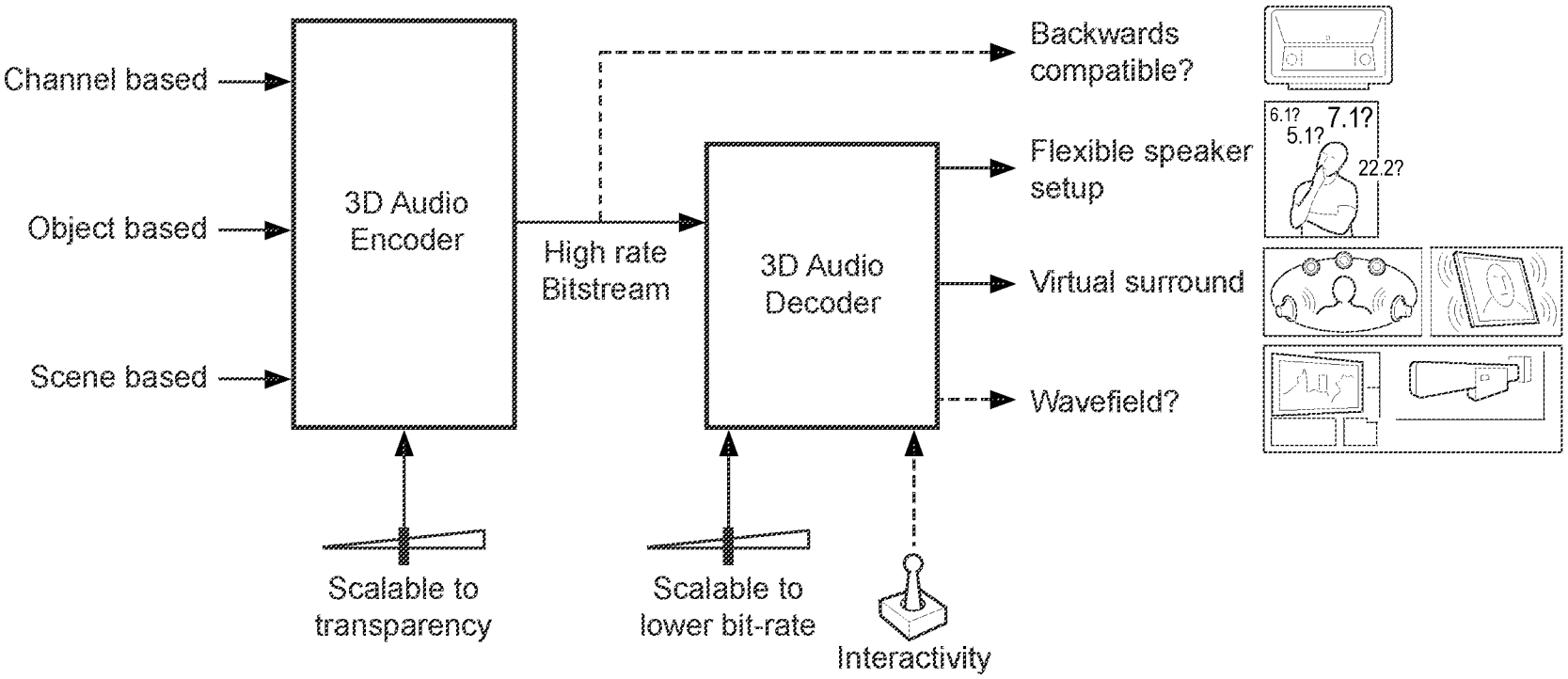
FIG. 5 illustrates an example of elements of an MPEG 3D Audio system in accordance with prior art.

The following description focuses on embodiments of the invention applicable to a rendering system arranged to render a plurality of rendering audio components of different types, and in particular to rendering of audio channels, audio objects and audio scene objects of an MPEG audio stream. However, it will be appreciated that the invention is not limited to this application but may be applied to many other audio rendering systems as well as other audio streams.

The described rendering system is an adaptive rendering system capable of adapting its operation to the specific audio transducer rendering configuration used, and specifically to the specific positions of the audio transducers used in the rendering.

The majority of existing sound reproduction systems only allow a very modest amount of flexibility in the loudspeaker set-up. Due to conventional systems generally being developed with basic assumptions regarding either the general configuration of the loudspeakers (e.g. that loudspeakers are positioned more or less equidistantly around the listener, or are arranged on a line in front of the listener etc.) and/or regarding the nature of the audio content (e.g. that it consists of a small number of separate localizable sources, or that it consists of a highly diffuse sound scene etc.), existing systems are typically only able to deliver an optimal experience for a limited range of loudspeaker configurations. This results in a significant reduction in the user experience and in particular in the spatial experience in many real-life use-cases and/or severely reduces the freedom and flexibility for the user to position the loudspeakers.

The rendering system described in the following provides an adaptive rendering system which is capable of delivering a high quality and typically optimized spatial experience for a large range of diverse loudspeaker set-ups. It thus provides the freedom and flexibility sought in many applications, such as for domestic rendering applications.

The rendering system is based on the use of a decision algorithm that selects one or more (spatial) rendering methods out of a set of different (spatial) sound rendering methods modes such that an improved and often optimal experience for the user(s) is achieved. The selection decision is based on the actual loudspeaker configuration used for the rendering. The configuration data used to select the rendering mode includes at least the (possibly three dimensional) positions of the loudspeakers, and may in some embodiments also consider other characteristics of the loudspeakers (such as size, frequency characteristics and directivity pattern). In many embodiments, the selection decision may further be based on the characteristics of the audio content, e.g. as specified in meta-data that accompanies the actual audio data.

In some embodiments, the selection algorithm may further use other available information to adjust or determine the settings of the selected rendering method(s).

Figure 6:
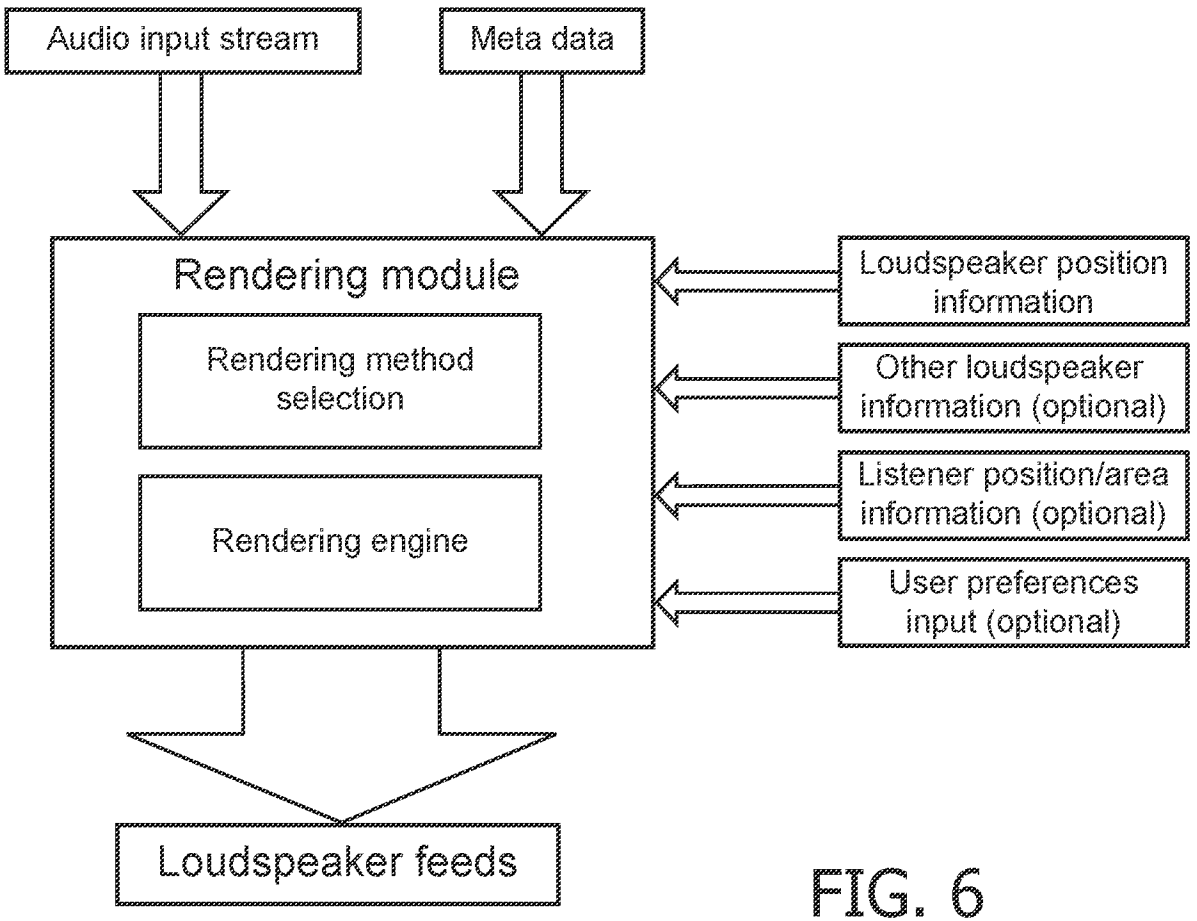
FIG. 6 illustrates an example of a principle of a rendering approach in accordance with some embodiments of the invention.

FIG. 6 illustrates an example of the principle of a rendering approach in accordance with some embodiments of the invention. In the example, a variety of data is considered when selecting a suitable rendering mode for audio components of an audio input stream.

Figure 7:
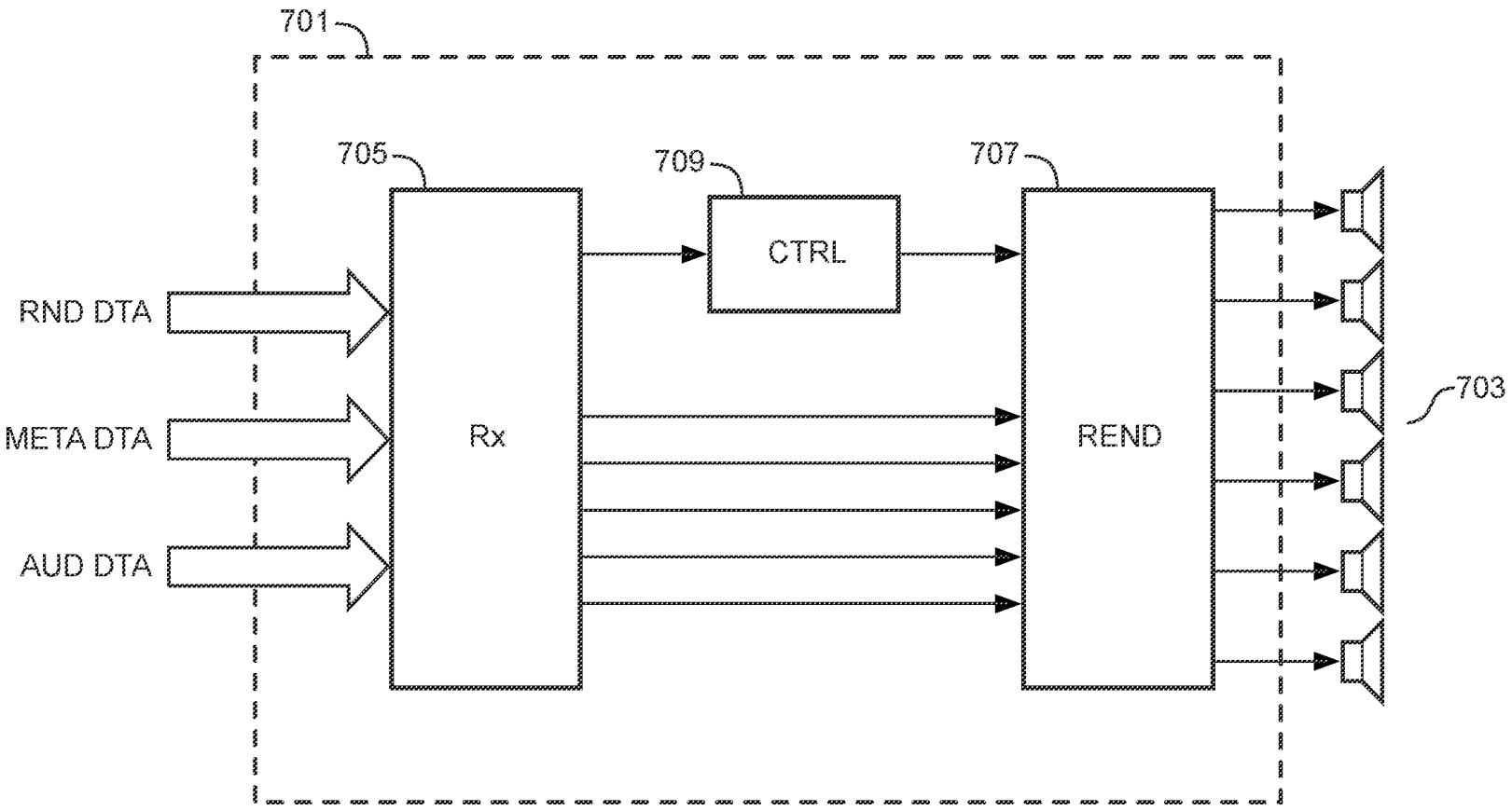
FIG. 7 illustrates an example of an audio processing apparatus in accordance with some embodiments of the invention.

FIG. 7 illustrates an example of an audio processing apparatus 701 in accordance with some embodiments of the invention. The audio processing apparatus 701 is specifically an audio renderer which generates signals for a set of audio transducers, which in the specific example are loudspeakers 703. Thus, the audio processing apparatus 701 generates audio transducer signals which in the specific example are drive signals for a set of loudspeakers 703. FIG. 7 specifically illustrates an example of six loudspeakers (such as for a 5.1 loudspeaker setup) but it will be appreciated that this merely illustrates a specific example and that any number of loudspeakers may be used.

The audio processing apparatus 701 comprises a receiver 705 which receives audio data comprising a plurality of audio components that are to be rendered from the loudspeakers 703. The audio components are typically rendered to provide a spatial experience to the user and may for example include audio channels, audio objects and/or audio scene objects.

The audio processing apparatus 701 further comprises a renderer 707 which is arranged to generate the audio transducer signals, i.e. the drive signals for the loudspeakers 703, from the audio data. Specifically, the renderer may generate drive signal components for the loudspeakers 703 from each of the audio components and then combine the drive signal components for the different audio components into single audio transducer signals, i.e. into the final drive signals that are fed to the loudspeakers 703. For brevity and clarity, FIG. 7 and the following description will not discuss standard signal processing operations that may be applied to the drive signals or when generating the drive signals. However, it will be appreciated that the system may include e.g. filtering and amplification functions.

The receiver 705 may in some embodiments receive encoded audio data which comprises encoded audio data for a plurality of audio components, and may be arranged to decode the audio data and provide decoded audio streams to the renderer 707. Specifically, one audio stream may be provided for each audio component. Alternatively one audio stream can be a downmix of multiple sound objects (as for example for a SAOC bitstream). In some embodiments, the receiver 705 may further be arranged to provide position data to the renderer 707 for the audio components, and the renderer 707 may position the audio components accordingly. In some embodiments, the position of all or some of the audio components may alternatively or additionally be assumed or predetermined, such as the default audio source position for an audio channel of e.g. a nominal surround sound setup. In some embodiments, position data may alternatively or additionally be provided from e.g. a user input, by a separate algorithm, or generated by the renderer itself.

In contrast to conventional systems, the audio processing apparatus 701 of FIG. 7 does not merely generate the drive signals based on a predetermined or assumed position of the loudspeakers 703. Rather, the system adapts the rendering to the specific configuration of the loudspeakers. Specifically, the system is arranged to select between a number of different algorithms depending on the positions of the loudspeakers and is furthermore capable of selecting different rendering algorithms for different loudspeakers.

It will be appreciated that the different rendering algorithms include the variety of audio rendering enhancement algorithms that may available in many audio devices. Often such algorithms have been designed to provide, for example, a better spatial envelopment, improved voice clarity, or a wider listening area for a listener. Such enhancement features may be considered as rendering algorithms and/or may be considered components of particular rendering algorithms.

In particular, the renderer 707 is operable to render the audio components in accordance with a plurality of rendering modes that have different characteristics. For example, some rendering modes will employ algorithms that provide a rendering which gives a very specific and highly localized audio perception whereas other rendering modes employ rendering algorithms that provide a diffuse and spread out position perception. Thus, the rendering and perceived spatial experience can differ very substantially depending on which rendering algorithm is used.

The renderer 707 is controlled by a render controller 709 which is coupled to the receiver 705 and to the renderer 707. The receiver 705 receives render configuration data which comprises data indicative of the rendering setup and specifically of the audio transducer/loudspeaker setup/configuration. The render configuration data specifically comprises audio transducer position data which is indicative of the positions of at least some of the loudspeakers 703.

It will be appreciated that the audio transducer position data may be any data providing an indication of a position of one or more of the loudspeakers 703, including absolute or relative positions (including e.g. positions relative to other positions of loudspeakers 703, relative to nominal (e.g. predetermined) positions for the loudspeakers 703, relative to a listening position, or the position of a separate localization device or other device in the environment).

It will also be appreciated that the audio transducer position data may be provided or generated in any suitable way. For example, in some embodiments the audio transducer position data may be entered manually by a user, e.g. as actual positions relative to a reference position (such as a listening position) or as distances and angles between loudspeakers. In other examples, the audio processing apparatus 701 may itself comprise functionality for estimating positions of the loudspeakers 703 based on measurements. For example, the loudspeakers 703 may be provided with microphones and this may be used to estimate positions. E.g. each loudspeaker 703 may in turn render a test signal, and the time differences between the test signal components in the microphone signals may be determined and used to estimate the distances to the loudspeaker 703 rendering the test signal. The complete set of distances obtained from tests for a plurality (and typically all) loudspeakers 703 can then be used to estimate relative positions for the loudspeakers 703.

The render controller 709 is arranged to control the render mode used by the renderer 707. Thus, the render controller 709 controls which specific rendering algorithms are used by the renderer 707. The render controller 709 selects the rendering modes based on the audio transducer position data, and thus the rendering algorithms employed by the audio processing apparatus 701 will depend on the positions of the loudspeakers 703.

However, rather than merely adjust the rendering characteristics or switch between the rendering modes for the system as a whole, the audio processing apparatus 701 of FIG. 7 is arranged to select rendering modes and algorithms for individual speaker subsets dependent on the positions of the individual loudspeakers 703. Thus, one rendering mode may be used for some loudspeakers 703 whereas another rendering mode may at the same time be used for other loudspeakers 703. The audio rendered by the system of FIG. 7 is thus a combination of the application of different spatial rendering modes for different subsets of the loudspeakers 703 where the spatial rendering modes are selected dependent on the locations of the loudspeakers 703.

The render controller 709 may specifically divide the loudspeakers 703 into a number of subsets and independently select the rendering mode for each of these subsets depending on the position of the loudspeakers 703 in the subset.

The use of different rendering algorithms for different loudspeakers 703 may provide improved performance in many scenarios and may allow an improved adaptation to the specific rendering setup while in many scenarios providing an improved spatial experience.

Specifically, the Inventors have realized that in many cases, a consumer will seek to place the loudspeakers as optimally as possible but that this is typically only possible or convenient for some loudspeakers. Thus, in many practical scenarios the positioning of the loudspeakers is compromised for a subset of the loudspeakers. For example, when setting up a surround sound system, users will often seek to position the loudspeakers at appropriate (e.g. equidistant) positions around the main listening areas. However, very often this may be possible for some loudspeakers but will not be possible for all loudspeakers. E.g. for many domestic home cinema systems, the front loudspeakers may be positioned at highly suitable positions around the display, and typically corresponding closely to the nominal position for these loudspeakers. However, in many situations, it is not possible or convenient to position the surround or rear loudspeakers appropriately, and the positions of these may be highly compromised. For example, the rear loudspeakers may be positioned asymmetrically, and e.g. both left and right rear loudspeakers may be positioned on one side of the listening position. In most conventional systems, the resulting degraded spatial experience is simply accepted and indeed for the rear surround loudspeakers this may often be considered acceptable due to the reduced significance of rear sounds sources.

However, in the system of FIG. 7, the deviation from the optimal rendering configuration may be detected and the render controller 709 may switch the rendering mode for the rear loudspeakers. Specifically, the rendering of audio from the front loudspeakers can be unchanged and follow the standard surround sound rendering algorithm. However, as the render controller 709 detects that one or more of the rear loudspeakers is positioned far from the default or optimum position, it may switch to use a different rendering algorithm which has different characteristics. Specifically, the render controller 709 may control the renderer 707 such that it for the rear loudspeakers switches from performing the default surround sound rendering to perform a different rendering algorithm which provides a more suitable perceptual input to the user.

For example, the render controller 709 may switch the renderer 707 to apply a rendering that introduces diffuseness and removes spatial definiteness of the sound sources. The rendering algorithm may for example add decorrelation to the rear channel audio components such that localized sound sources will no longer be well defined and highly localized but rather appear to be diffuse or spread out. Thus, if the render controller 709 detects that all the loudspeakers 703 are at suitable default positions, it applies a standard surround sound rendering algorithm to generate the drive signals. However, if it detects that one or more of the rear loudspeakers are positioned far from the default position, it switches the rendering algorithm used to generate the drive signals for these loudspeakers to a rendering algorithm that introduces diffuseness. Thus, rather than perceive well defined and localized sound sources at wrong positions, the listener will instead perceive the sound sources to not be localized but e.g. to arrive diffusely from the rear. This will in many cases provide a more preferred user experience. Furthermore, the system is capable of automatically adapting to provide such an improved experience without compromising the performance for scenarios wherein the rear loudspeakers are indeed positioned at the desired positions. Furthermore, since the adaptation is limited to the subset of loudspeakers directly affected by the suboptimal position, the improvement is achieved without compromising the performance of the other loudspeakers. In particular, the front audio stage is not substantially affected and in particular highly localized front audio sources remain highly localized front audio sources at the same positions.

However, as an alternative embodiment one may consider a case where a user prefers clearly localizable sound rather than diffuse rendering even if the locations are not exactly correct. In this case rendering method with less diffuse reproduction method may be selected based on a user preference.

As another example, the renderer 707 may be controlled to use render modes that reflect how separable the perception of the loudspeakers 703 are. For example, if it is detected that some loudspeakers are positioned so closely together that they are essentially perceived as a single sound source (or at least as two correlated sound sources), the render controller 709 may select a different rendering algorithm for these loudspeakers 703 than for loudspeakers that are sufficiently far apart to function as separate sound sources. For example, a rendering mode that uses an element of beamforming may be used for loudspeakers that are sufficiently close whereas no beamforming is used for loudspeakers that are far apart.

It will be appreciated that many different rendering modes and algorithms may be used in different embodiments. In the following, an example of rendering algorithms that may be comprised in the set of rendering modes which can be selected by the render controller 709 will be described. However, it will be appreciated that these are merely exemplary and that the concept is not limited to these algorithms.

Standardized Stereophonic Rendering

This refers to classic amplitude-panning-based rendering in standardized loudspeaker set-ups, in which each audio channel is assumed to directly correspond to one of the loudspeakers. It may refer to two-channel stereophony (with two loudspeakers at symmetrical azimuths relative to the listening position), as well as to multi-channel extensions of the same concept, such as ITU 5.1-channel and 7-channel surround sound, as well as 3D extensions such as 22.2.

This method performs well in cases in which loudspeakers are positioned according to the assumed standardized configuration, and the listener is positioned in the center (the "sweet spot"). If these conditions are not satisfied, stereophonic rendering is well-known to perform sub-optimal.

Vector Base Amplitude Panning Rendering

This is a method which is basically a generalization of the stereophonic rendering method that supports non-standardized loudspeaker configurations by adapting the amplitude panning law between pairs of loudspeakers to more than two loudspeakers placed in known two or three dimensional positions in space. Detailed description of this method can be found in e.g. V. Pulkki, "Virtual Sound Source Positioning Using Vector Base Amplitude Panning", J.AudioEng. Soc., Vol. 45, No. 6, 1997.

The approach is particularly suitable in use-cases in which the loudspeakers are distributed more or less randomly around the listener, without any extremely large or extremely small "gaps" in between. A typical example is a case in which loudspeakers of a surround sound system are placed "more or less" according to the specifications, but with some deviations for individual loudspeakers.

A limitation of the method is that the localization performance is degraded in cases in which large "gaps" between loudspeaker pairs exist, especially at the sides, and that sources cannot be positioned outside the regions "covered" by the loudspeaker pairs.

Beamform Rendering

Beamforming is a rendering method that is associated with loudspeaker arrays, i.e. clusters of multiple loudspeakers which are placed closely together (e.g. with less than several decimeters in between). Controlling the amplitude- and phase relationship between the individual loudspeakers allows sound to be "beamed" to specified directions, and/or sources to be "focused" at specific positions in front or behind the loudspeaker array. Detailed description of this method can be found in e.g. Van Veen, B. D, Beamforming: a versatile approach to spatial filtering, ASSP Magazine, IEEE (Volume:5, Issue: 2), Date of Publication: April 1988.

A typical use case in which this type of rendering is beneficial, is when a small array of loudspeakers is positioned in front of the listener, while no loudspeakers are present at the rear or even at the left and right front. In such cases, it is possible to create a full surround experience for the user by "beaming" some of the audio channels or objects to the side walls of the listening room. Reflections of the sound off the walls reach the listener from the sides and/or behind, thus creating a fully immersive "virtual surround" experience. This is a rendering method that is employed in various consumer products of the "soundbar" type.

Another example in which beamforming rendering can be employed beneficially, is when a sound channel or object to be rendered contains speech. Rendering these speech audio components as a beam aimed towards the user using beamforming may result in better speech intelligibility for the user, since less reverberation is generated in the room.

Beamforming would typically not be used for (sub-parts of) loudspeaker configurations in which the spacing between loudspeakers exceeds several decimeters.

Cross-Talk Cancellation Rendering

This is a rendering method which is able to create a fully immersive 3D surround experience from two loudspeakers. It is closely related to binaural rendering over headphones using Head Related Transfer Functions (or HRTF's). Because loudspeakers are used instead of headphones, feedback loops have to be used to eliminate cross-talk from the left loudspeaker to the right ear and vice versa. Detailed description of this method can be found in e.g. Kirkeby, Ole; Rubak, Per; Nelson, Philip A.; Farina, Angelo, Design of Cross-Talk Cancellation Networks by Using Fast Deconvolution, AES Convention:106 (May 1999) Paper Number: 4916.

This is particularly useful in situations in which there are two loudspeakers placed at symmetrical azimuths relative to the listener. In particular, this rendering method may be employed to render a full surround experience form a standard two-loudspeaker stereophonic set-up.

This method is less suitable if there multiple listeners or listening positions, as the method is very sensitive to listener position.

Stereo Dipole Rendering

This rendering method uses two or more closely-spaced loudspeakers to render a wide sound image for a user by processing a spatial audio signal in such a way that a common (sum) signal is reproduced monophonically, while a difference signal is reproduced with a dipole radiation pattern. Detailed description of this method can be found in e.g. Kirkeby, Ole; Nelson, Philip A.; Hamada, Hareo, The 'Stereo Dipole': A Virtual Source Imaging System Using Two Closely Spaced Loudspeakers, JAES Volume 46 Issue 5 pp. 387-395; May 1998. This is useful in situations in which the front loudspeaker set-up consists of two closely spaced loudspeakers, such as when a tablet is used to watch a movie.

Ambisonics Rendering

Ambisonics is a spatial audio encoding and rendering method which is based on decomposing (at the recording side) and reconstructing (at the rendering side) a spatial sound field in a single position. In recording, a special microphone configuration is often used to capture individual "spherical harmonic components" of the sound field. In reproduction, the original sound field is reconstructed by rendering the recorded components from a special loudspeaker set-up. Detailed description of this method can be found in e.g. Jérôme Daniel, Rozenn Nicol, and Sébastien Moreau, Further Investigations of High Order Ambisonics and Wavefield Synthesis for Holophonic Sound Imaging, Presented at the 114th Convention 2003 Mar. 22-25.

This rendering method is particularly useful in cases in which the loudspeaker configuration is essentially equidistantly distributed around the listener. In such cases, ambisonics rendering may provide a more immersive experience than any of the methods described above, and the listening area in which a good experience is obtained may be larger.

In particular, it may be useful to render diffuse (ambience) audio components.

The method is less suitable for irregularly placed loudspeaker configurations.

Wave Field Synthesis Rendering

This is a rendering method that uses arrays of loudspeakers to accurately recreate an original sound field within a large listening space. Detailed description of this method can be found in e.g. Boone, Marinus M.; Verheijen, Edwin N. G. Sound Reproduction Applications with Wave-Field Synthesis, AES Convention:104 (May 1998) Paper Number:4689.

It is particularly suitable for object-based sound scenes, but is also compatible with other audio types (e.g. channel- or scene-based). A restriction is that it is only suitable for loudspeaker configurations with a large number of loudspeakers spaced no more than about 25 cm apart. In a typical case this is based on arrays of loudspeakers or devices where multiple individual drivers are enclosed in the same housing.

Least Squares Optimized Rendering

This is generic rendering method that attempts to achieve a specified target sound field by means of a numerical optimization procedure in which the loudspeaker positions are specified as parameters and the loudspeaker signals are optimized such as to minimize the difference between the target- and reproduced sound fields within some listening area.

Detailed description of this method can be found in e.g. Shin, Mincheol; Fazi, Filippo M.; Seo, Jeongil; Nelson, Philip A., Efficient 3-D Sound Field Reproduction, AES Convention:130 (May 2011) Paper Number:8404.

In some cases these methods require placing a microphone to the desired listening position in order to capture the reproduced sound field.

It will be appreciated that in some embodiments, a completely separate rendering engine may be implemented for each rendering mode. In other embodiments, some of the rendering algorithms/modes may share at least some functionality. In many embodiments, each rendering mode may be implemented as a rendering firmware algorithm with all algorithms executing on the same signal processing platform. For example, the render controller 709 may control which rendering subroutines are called by the renderer 707 for each audio transducer signal and audio component.

Figure 8:
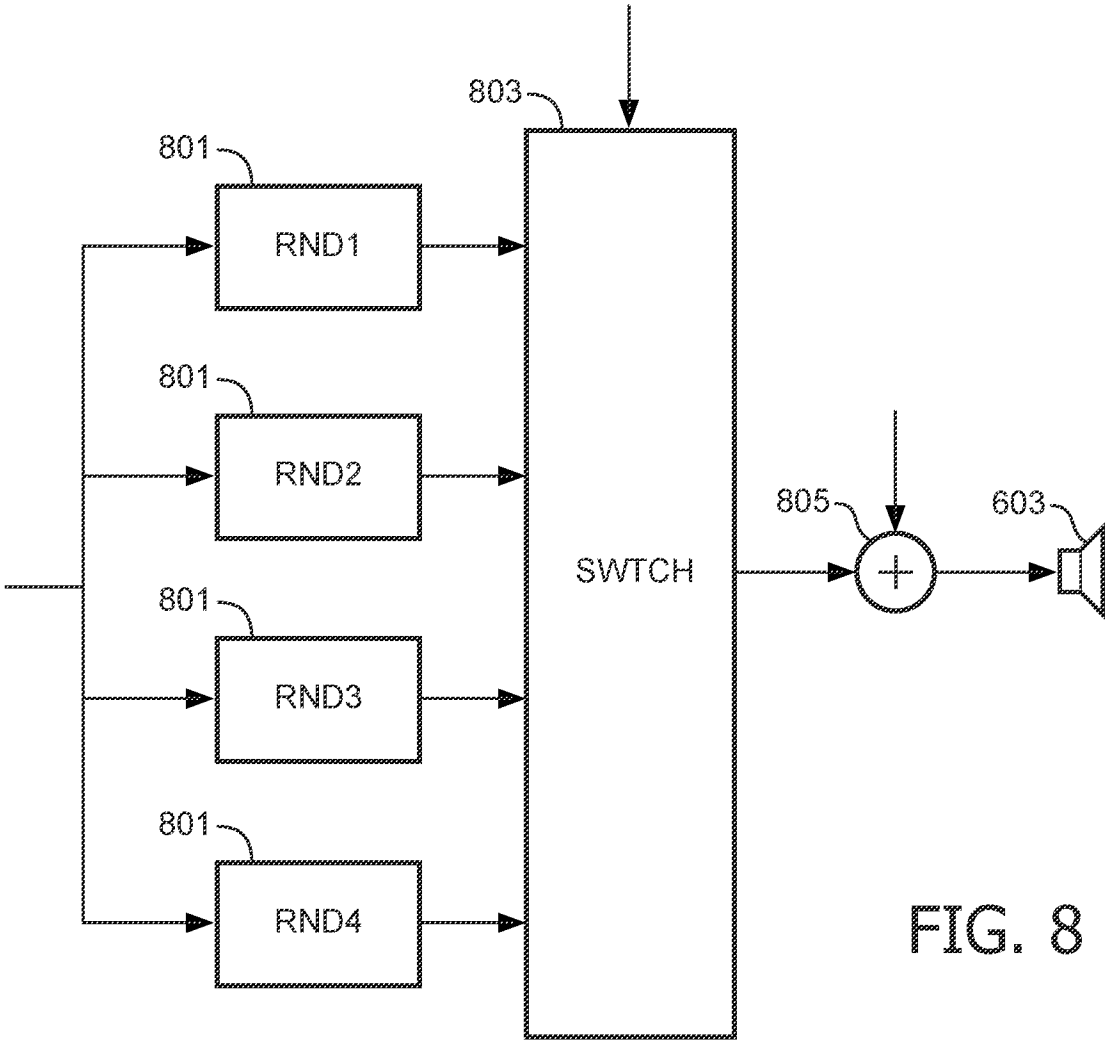
FIG. 8 an example of elements of a renderer for the audio processing apparatus of FIG. 7.

An example of how the renderer 707 may be implemented for a single audio component and a single audio transducer signal is illustrated in FIG. 8.

In the example, the audio component is fed to a plurality of rendering engines 801(in the specific example four rendering engines are shown but it will be appreciated that more or less may be used in other embodiments). Each of the rendering engines 801 is coupled to a switch which is controlled by the render controller 709. In the example, each of the rendering engines 801 may perform a rendering algorithm to generate the corresponding drive signal for the loudspeaker 703. Thus, the switch 803 receives drive signals generated in accordance with all the possible rendering modes. It then selects the drive signal which corresponds to the rendering mode that has been selected by the render controller 709 and outputs this. The output of the switch 803 is coupled to a combiner 805 which in the specific example is a summation unit. The combiner 805 may receive corresponding drive signal components generated for other audio components and may then combine the drive signal components to generate the drive signal fed to the loudspeaker 703.

It will be appreciated that in other examples, the switching may be performed prior to the rendering, i.e. the switch may be at the input to the rendering engines 801. Thus, only the rendering engine corresponding to the rendering mode selected by the render controller 709 is activated to generate a drive signal for the audio component, and the resulting output of this rendering engine is coupled to the combiner 805.

It will also be appreciated that FIG. 8 for clarity and brevity shows the rendering engines 801 operating independently on each audio component. However, in most typical applications, the rendering algorithm may be a more complex algorithm which simultaneously takes into account more than one audio component when generating the audio signals.

Similarly, it will be appreciated that many rendering algorithms generate outputs for a plurality of loudspeakers 703. For example, an amplitude panning may generate at least two drive signal components for each audio component. These different drive signals may for example be fed to different output switches or combiners corresponding to the different audio transducers.

In many embodiments, the different rendering modes and algorithms may be predetermined and implemented as part of the audio processing apparatus 701. However, in some embodiments, the rendering algorithm may be provided as part of the input stream, i.e. together with the audio data.

In many embodiments, the rendering algorithms may be implemented as matrix operations applied to time-frequency tiles of the audio data as will be known to the person skilled in the art.

In some embodiments, the same rendering modes may be selected for all audio components, i.e. for a given loudspeaker 703 a single rendering mode may be selected and that may be applied to all audio components which provide a contribution to the sound rendered from that loudspeaker 703. However, in other embodiments, the rendering mode for a given loudspeaker 703 may be different for different audio components.

This may for example be the case in a situation where the audio components correspond to five spatial channels of a surround sound system. In a possible scenario, the audio transducer position data may indicate that e.g. the right rear loudspeaker is positioned much further forward than the nominal position and indeed is positioned in front and to the side of the listener. At the same time, the right front loudspeaker may be positioned more central than the left front loudspeaker. In such an example, it may be advantageous to render the front right channel using an amplitude panning algorithm between the right front loudspeaker and the right rear loudspeaker. This may result in a perceived position for the right front channel further to the right of the front right loudspeaker and may specifically result in symmetrically perceived positions for the front right and front left channels. At the same time, the right rear channel may be rendered from the right rear channel but using a rendering algorithm which introduces a high degree of diffuseness in order to obscure the fact that the right rear loudspeaker is positioned too far forward. Thus, the rendering modes selected for the right rear loudspeaker will be different for the right front channel audio component and the right rear channel audio component.

In some embodiments, all audio components may be the same audio type. However, the audio processing apparatus 701 may provide particularly advantageous performance in embodiments wherein the audio components may be of different types.

Specifically, the audio data may provide a number of audio components that may be include a plurality of audio types from the group of: audio channel components, audio object components, and audio scene components.

In many embodiments, the audio data may include a number of components that may be encoded as individual audio objects, such as e.g. specific synthetically generated audio objects or microphones arranged to capture a specific audio source, such as e.g. a single instrument.

Each audio object typically corresponds to a single sound source. Thus, in contrast to audio channels, and in particular audio channels of a conventional spatial multichannel signal, the audio objects typically do not comprise components from a plurality of sound sources that may have substantially different positions. Similarly, each audio object typically provides a full representation of the sound source. Each audio object is thus typically associated with spatial position data for only a single sound source. Specifically, each audio object may typically be considered a single and complete representation of a sound source and may be associated with a single spatial position.

Audio objects are not associated with any specific rendering configuration and are specifically not associated with any specific spatial configuration of sound transducers/loudspeakers. Thus, in contrast to audio channels which are associated with a rendering configuration such as a specific spatial loudspeaker setup (e.g. a surround sound setup), audio objects are not defined with respect to any specific spatial rendering configuration.

An audio object is thus typically a single or combined sound source treated as an individual instance, e.g. a singer, instrument or a choir. Typically, the audio object has associated spatial position information that defines a specific position for the audio object, and specifically a point source position for the audio object. However, this position is independent of a specific rendering setup. An object (audio) signal is the signal representing an audio object. An object signal may contain multiple objects, e.g. not concurrent in time.

A single audio object may also contain multiple individual audio signals, for example, simultaneous recordings of the same musical instrument from different directions.

In contrast, an audio channel is associated with a nominal audio source position. An audio channel thus typically has no associated position data but is associated with a nominal position of a loudspeaker in a nominal associated loudspeaker configuration. Thus, whereas an audio channel is typically associated with a loudspeaker position in an associated configuration, an audio object is not associated with any loudspeaker configuration. The audio channel thus represents the combined audio that should be rendered from the given nominal position when rendering is performed using the nominal loudspeaker configuration.

The audio channel thus represents all audio sources of the audio scene that require a sound component to be rendered from the nominal position associated with the channel in order for the nominal loudspeaker configuration to spatially render the audio source. An audio object in contrast is typically not associated with any specific rendering configuration and instead provides the audio that should be rendered from one sound source position in order for the associated sound component to be perceived to originate from that position.

An audio scene component is characterized by being one of a set of orthogonal spatial components in which an original audio sound field can be mathematically decomposed.

Specifically, it may be one of a set of orthogonal spherical harmonic components of the original sound field which together fully describe the original sound field at a defined position within the original sound field. Even more specifically, it may be a single component of a set of High-Order Ambisonics (HOA) components.

An audio scene component is differentiated from an audio component channel by the fact that it does not directly represent a loudspeaker signal. Rather, each individual audio scene component contributes to each loudspeaker signal according to a specified panning matrix.

Furthermore, an audio component is differentiated from an audio object by the fact that it does not contain information about a single individual sound source, but rather contains information about all sound sources that are present in the original sound field (both "physical" sources and "ambience" sources such as reverberation).

In a practical example, one audio scene component may contain the signal of an omnidirectional microphone at a recording position, while three other audio scene components contain the signals of three velocity (bi-directional) microphones positioned orthogonally at the same position as the omnidirectional microphone. Additional audio scene components may contain signals of higher-order microphones (either physical ones, or synthesized ones from the signals of spherical microphone array). Alternatively, the audio scene components may be generated synthetically from a synthetic description of the sound field.

In some embodiments, the audio data may comprise audio components that may be audio channels, audio objects and audio scenes in accordance with the MPEG standard ISO/IEC 23008-3 MPEG 3D Audio.

In some embodiments, the selection of the rendering modes is further dependent on the audio type of the audio component. Specifically, when the input audio data comprises audio components of different types, the render controller 709 may take this into account and may select different rendering modes for different audio types for a given loudspeaker 703.

As a simple example, the render controller 709 may select the use of an amplitude panning rendering mode to compensate for loudspeaker position errors for an audio object which is intended to correspond to a highly localized source and may use a decorrelated rendering mode for an audio scene object which is not intended to provide a highly localized source.

In many embodiments, the audio type will be indicated by meta-data received with the audio object. In some embodiments, the meta-data may directly indicate the audio type whereas in other embodiments it may be an indirect indication, for example by comprising positional data that is only applicable to one audio type.

The receiver 705 may thus receive such audio type indication data and feed this to the render controller 709 which uses it when selecting the appropriate rendering modes. Accordingly, the render controller 709 may select different rendering modes for one loudspeaker 703 for at least two audio components that are of different types.

In some embodiments, the render controller 709 may comprise a different set of rendering modes to choose from for the different audio types. For example, for an audio channel a first set of rendering modes may be available for selection by the render controller 709, for an audio object a different set of rendering modes may be available, and for an audio scene object yet another set of rendering modes may be available.

As another example, the render controller 709 may first generate a subset comprising the available rendering methods that are generally suitable for the actual loudspeaker set-up. Thus, the render configuration data may be used to determine a subset of available rendering modes. The subset will thus depend on the spatial distribution of the loudspeakers. As an example, if the loudspeaker set-up consists of a number of loudspeakers that are distributed more or less equidistantly around the listener, the module may conclude that vector based amplitude panning and ambisonic rendering modes are possible suitable methods, while beamforming is not.

As a next step, the other available information is used by the system to decide between the rendering modes of the generated subset. Specifically, the audio type of the audio objects may be considered. For example, for audio channels, vector based amplitude panning may be selected over ambisonic rendering while for audio objects that (e.g. as indicated by meta-data) should be rendered as highly diffuse, ambisonic rendering may be selected.

In the following, some possible examples are given:

Standard stereophonic rendering may be selected if the loudspeaker configuration essentially conforms to a standard stereophonic (multi-channel) loudspeaker configuration and the audio type is "channel-based" or "object-based".

Vector Base Amplitude Panning may be selected when the loudspeakers are distributed more or less randomly around the listener, without any extremely large or extremely small "gaps" in between, and the audio type is "channel-based" or "object-based".

Beamforming rendering may be selected if loudspeakers are clustered to a closely-spaced closely array (e.g. with less than several decimeters in between).

Cross-talk cancellation rendering may be selected when there are two loudspeakers placed at symmetrical azimuths relative to the listener and there is only a single user.

Stereo Dipole rendering may be selected in situations in which the front loudspeaker set-up consists of two closely spaced loudspeakers, such as when a tablet is used to watch a movie.

Ambisonics rendering may be selected when the loudspeaker configuration is essentially equidistantly distributed around the listener and the audio type is "audio scene component" or a "diffuse" (ambience) "audio object" type.

Wave field synthesis rendering may be selected for any audio type for loudspeaker configurations with a large number of loudspeakers spaced no more than about 25 cm apart, and when a large listening area is desired.

Least squares optimized rendering may be selected for any audio type in situations in which other available rendering methods do not perform satisfactorily.

The combination of an individual and independent selection of a suitable rendering mode for individual audio types and individual loudspeaker subsets in dependence on the positions of these loudspeakers provides a particularly advantageous operation and a high quality spatial experience.

However, it will be appreciated that the selection of rendering algorithms based on an audio type is not in principle restricted to scenarios wherein different rendering algorithms are selected for different subsets of loudspeakers.

For example, an audio processing apparatus could comprise a receiver for receiving audio data, audio description data, and render configuration data, the audio data comprising audio data for a plurality of audio components of different audio types, the audio description data being indicative of at least an audio type of at least some audio components, and the render configuration data comprising audio transducer position data for a set of audio transducers; a renderer for generating audio transducer signals for the set of audio transducers, the renderer being capable of rendering audio components in accordance with a plurality of rendering modes; a render controller arranged to select a rendering mode for the renderer out of the plurality of rendering modes for each audio component of the plurality of audio components in response to the audio description data and the render configuration data/audio transducer position data.

Thus, in such a system, the rendering modes may not be individually selected for different subsets of audio transducers but could be selected for all audio transducers. In such a system, the described operation would follow the principles described for the audio processing apparatus 701 of FIG. 7 but would simply consider the audio transducer set as a whole and potentially select the same rendering algorithm for all loudspeakers 703. Thus, the description is mutatis mutandis also applicable to such a system.

However, in the system of FIG. 7, the selection of rendering modes based on the audio description data, and specifically based on the audio type data, is performed independently for different subsets of loudspeakers 703 such that the rendering modes for the different subsets may be different. Accordingly, an improved adaptation to the specific rendering configuration and loudspeaker setup as well as to the rendered audio is achieved.

It will be appreciated that different algorithms and selection criteria for selecting the rendering mode for individual loudspeakers may be used in different embodiments.

In many embodiments, the render controller 709 is arranged to select the rendering mode for a given loudspeaker based on the position of that loudspeaker relative to a predetermined position. Specifically, the rendering mode may in many embodiments be selected depending on how much the actual position actually deviates from a nominal or default position.

For example, for rendering of most audio channels, a default loudspeaker setup is assumed. E.g., in many systems a set of substantially equidistant loudspeakers surrounding the listening position at equal distance is assumed. For such an audio object, the render controller 709 may be arranged to select the rendering mode for the loudspeakers depending on how close they are to the default position.

In many embodiments, a default rendering mode may be designated for each audio type. The default rendering mode may provide an advantageous spatial experience to users for situations where the loudspeakers are positioned at their correct default positions, or where they only deviate by a small amount from these. However, if one or more of the loudspeakers is positioned far from the appropriate position, the rendered sound may not provide the desired spatial audio experience. For example, if the rear right loudspeaker is positioned on the left hand side of the user, the rear sound stage will be distorted. This particular scenario provides an example of how a possible rendering mode selection approach may improve the perceived experience. E.g. if the rear loudspeakers are essentially at the correct angles but the left and right surround channels are swapped around, it is often better to select a rendering method that simply swaps the two channels back to their correct places rather than using for example a method based on amplitude panning which may additionally lead to leakage of sound between the channels.

Thus, in some embodiments, the render controller 709 may determine the position of each loudspeaker relative to the default position. If the difference is below a given threshold (which may be predetermined or may be adapted dynamically), the default rendering mode is selected. For example, for an audio channel component, the rendering mode may simply be one that feeds the audio channel to the appropriate loudspeaker positioned at the default assumed position. However, if the loudspeaker position deviates by more than a threshold, a different rendering mode is selected. For example, in this case, an amplitude panning rendering mode is selected based on the loudspeaker and a second loudspeaker on the other side of the default position. In this case, the amplitude panning rendering can be used to render sound corresponding to the default position even if the loudspeaker is not positioned at this position.

As a specific example, if the rear right loudspeaker is positioned to the left of the listener, the rear right surround channel may be rendered using amplitude panning between the rear right loudspeaker and the front right loudspeaker. Thus, the rendering mode may be changed both for the loudspeaker which is not in the correct position (the rear right loudspeaker) but also for another loudspeaker which may be at the default position (the right front loudspeaker).

However, the rendering mode for other loudspeakers may still use the default rendering approach (the center, front left and rear left loudspeakers). Also, whereas the rendering mode for a loudspeaker at the default position may be changed due to the position of another loudspeaker being away from its default position, this modified rendering may only apply to some audio components. For example, the rendering of a front audio object may use the default rendering for the right front loudspeaker.

In some embodiments, the render controller 709 may for a given audio object divide the loudspeakers 703 into at least two subsets. The first subset may include at least one loudspeaker 703 for which the difference between the position of the audio transducer and the predetermined position exceeds a given threshold. The second subset may include at least one loudspeaker 703 for which the difference between the position of the audio transducer and the predetermined position does not exceed a threshold. The set of rendering modes that may be selected by the render controller 709 may in this embodiment be different.

Specifically, for the second subset, the rendering mode may be selected from a set of default rendering modes. Indeed, in some scenarios, the set of default rendering modes may comprise only a single default rendering mode. For the first subset however, the rendering mode may be selected from a different set of rendering modes which specifically may comprise only non-default rendering modes. It will be appreciated that the first subset of loudspeakers may potentially also include one or more loudspeakers that are at the default position. E.g. for a right rear loudspeaker positioned to the left of the user, the first subset may include not only the right rear loudspeaker but also the right front loudspeaker.

As another example, a system may consist of a small number of closely spaced loudspeakers in front of the listener, and two rear loudspeakers at the "standard" left- and right surround positions. In this case, the second subset may consist of the two rear- and the central one of the closely-spaced front loudspeakers, and the left- and right surround and center channels of a channel-based signal may be sent directly to the corresponding speakers. The closely-spaced front loudspeakers, including the "center" one of the second sub-set, form the first sub-set in this case, and beamforming rendering may be applied to them for reproducing a front left- and right channel of the channel-based signal.

In some embodiments, the render controller 709 may consider other render configuration data when selecting the appropriate rendering modes.

For example, the render controller 709 may be provided with information about the listening position and may use this to select a suitable algorithm. For example, if the listening position changes to be asymmetric with respect to the loudspeaker setup, the render controller 709 may bias the selection towards the use of vector based amplitude panning in order to compensate for such asymmetry.

As another example, in cases in which the listening position is dynamic and the loudspeaker configuration consists of arrays of loudspeakers surrounding the listener, Wave Field Synthesis rendering may be used to provide an optimal listening experience at all positions within a large listening area.

As yet another example, if the position of the user can be tracked and only a few loudspeakers in front of the listener are available, cross-talk cancellation rendering may be used and may be controlled adaptively according to the listener position data, It will be appreciated that different approaches for selecting and evaluating different rendering modes or combinations of rendering modes may be used in different embodiments. For example, in many embodiments, the render controller 709 may be arranged to select the rendering mode in response to a quality metric generated by a perceptual model. Specifically, the render controller 709 may be arranged to select the rendering mode based on a quality metric resulting from a computational perceptual model. For example, the render controller 709 may be arranged to use a computational simulation of the expected listening experience for a user to evaluate which rendering method provides a sound image that is closest to the ideal rendering of the audio data. The approach may for example be based on methods such as those described in M. Park, P. A. Nelson, and K. Kang, "A Model of Sound Localisation Applied to the Evaluation of Systems for Stereophony," Acta Acustica united with Acustica, 94(6), 825-839, (2008).

Such perceptual models may specifically be capable of calculating a quality measure or metric based on the inputs to the ears of a listener. Thus, the model may for a given input for each ear of a listener estimate the quality of the perceived spatial experience.

As an example, the render controller 709 may accordingly evaluate different combinations of rendering modes, where each combination corresponds to a selection of rendering modes for different subsets of speakers. For each of these combinations, the resulting signals at the ears of a listener at a default listening position may be calculated. This calculation takes into account the positions of the loudspeakers 703 including potentially room characteristics etc.

For example, the audio that is rendered from each speaker (assuming the specific rendering modes of the combination being evaluated) may first be calculated. A transfer function may be estimated from each speaker to each ear of a listener based on the specific positions of the speaker, and the resulting audio signals at the ears of a user may accordingly be estimated by combining the contributions from each speaker and taking the estimated transfer functions into account. The resulting binaural signal is then input to a computational perceptual model (such as one proposed in the above mentioned article) and a resulting quality metric is calculated. The approach is repeated for all combinations resulting in a set of quality metrics. The render controller 709 may then select the combination of rendering modes that provides the best quality metric.

Each combination of rendering modes may correspond to a possible selection of rendering modes for a plurality of subsets of loudspeakers 703, where the rendering mode for each subset may be individually selected. Furthermore, different combinations may correspond to divisions into different subsets. For example, one combination may consider a stereophonic rendering for the front speakers and a least squares rendering for the rear speakers; another may consider beamform rendering for the front speakers and least squares rendering for the rear speakers, another may consider amplitude panning for the left speakers and stereophonic rendering for the rear and center speakers etc.

Indeed in principle, and indeed some embodiments, the combinations may include all possible divisions into subsets and all possible rendering mode selections for those subsets.

However, it will be appreciated that in many embodiments, such an evaluation may be too complex and computationally intensive. In many embodiments, the number of combinations may be reduced substantially, for example by dividing the speakers into subsets based on their position (e.g. with one subset being all speakers close to their default position and another being all speakers that are not close to their default position), and only these subsets are considered. Alternatively or additionally, other requirements or criteria may be used to reduce the number of rendering modes that are considered for each subset. For example, beamforming may be disregarded for all subsets in which the loudspeaker positions are not sufficiently close together.

In some embodiments, the render controller 709 may accordingly be arranged to generate binaural signal estimates for a plurality of combinations of rendering modes for different subsets of speakers; to determine a quality metric for each combination in response to the binaural signal estimates; and to select the rendering modes as the combination of rendering modes for which the quality metric indicates a highest quality.

In many embodiments, the rendering mode for a given loudspeaker subset is selected based on the positions of the loudspeakers in the subset. However, in some embodiments, the render controller 709 may further take the position of loudspeakers that are not part of the subset into account. For example, in a scenario wherein the rendering of an audio object is desired to be at a position where there is not a single loudspeaker in the near vicinity (e.g. a source behind the listener while only loudspeakers are present in front of the listener), a "virtual rendering" algorithm such as cross-talk cancellation, or beamforming rendering may be employed, the ultimate selection between these options being dependent on the characteristics of the actual loudspeaker configuration (e.g. spacing).

In some embodiments, the render controller 709 may be arranged to further take the audio rendering characteristics data of loudspeakers 703 into account in the selection of the rendering mode. For example, if an overhead loudspeaker of a 3D loudspeaker set-up is a small tweeter which is incapable of reproducing low frequencies (plausible, since mounting a large full-range speaker on the ceiling is not straightforward), the low-frequency part of the signal intended for the overhead speaker may be distributed equally to all full range speakers surrounding the listener in the horizontal plane.

In some embodiments, the render controller 709 may be arranged to select the rendering mode in response to user rendering preferences. The user preferences may for example be provided as a manual user input. In some embodiments, the user preferences may be determined in response to user inputs that are provided during operation. For example, the audio processing apparatus 701 may render audio while switching between possible rendering modes. The user may indicate his preferred rendering and the audio processing apparatus 701 may store this preference and use it to adapt the selection algorithm. For example, a threshold for the selection between two possible rendering modes may be biased in the direction of the user's preferences.

In some embodiments, the receiver 705 may further receive rendering position data for one or more of the audio components and the selection of the rendering mode for the one or more audio components may depend on the position.

For example, an audio object for a localized sound source may be received together with position data indicating a position at which the audio object should be rendered. The render controller 709 may then evaluate if the position corresponds to one which for the specific current loudspeaker setup can be rendered accurately at the desired position using vector based amplitude panning. If so, it proceeds to select a vector based amplitude panning rendering algorithm for the audio object. However, if the current rendering configuration does not allow the amplitude panning to provide a suitable sound source positioning (e.g. due to the relevant loudspeakers being arranged only on the other side of the user), the render controller 709 may instead select a rendering approach which decorrelates the drive signals between two or more loudspeakers in order to generate a diffuse spatial perception of the sound source position.

In some embodiments, the approach may be applied in individual frequency bands.

Specifically, in some embodiments, the audio processing apparatus 701 may be arranged to potentially use different rendering algorithms for different frequency bands of an audio component. In such embodiments, the render controller 709 may be arranged to perform an independent selection of rendering modes for the different frequency bands.

For example, the renderer 707 may be arranged to divide a given audio component into a high frequency component and a low frequency component (e.g. with a cross over frequency of around 500 Hz). The rendering of each of these components may be performed individually and thus different rendering algorithms may potentially be used for the different bands. The additional freedom allows the render controller 709 to optimize the selection of rendering modes to the specific spatial significance of the audio components in the different bands.

Specifically, human spatial perception is generally more dependent on spatial cues at higher frequencies than at lower frequencies. Accordingly, the render controller 709 may select a rendering mode for the high frequency band which provides the desired spatial experience whereas for the low frequency band a different and simpler rendering algorithm with reduced resource demand may be selected.

As another example, the render controller 709 may detect that a subset of the loudspeakers can be considered to be arranged as an array with a certain spacing, defined as the maximum distance between any two neighboring loudspeakers of the sub-set. In such a case, the spacing of the array determines an upper frequency for which the sub-set can effectively and advantageously be used as an array for e.g. beamforming or wave field synthesis, or least-squares. The render controller 709 may then split the audio component to generate a low-frequency component which is rendered using any of the array-type rendering methods.

In many embodiments, the audio processing apparatus 701 may be arranged to dynamically change the selection of the rendering modes. For example, as the characteristics of the audio components change (e.g. from representing a specific sound source to general background noise when e.g. a loudspeaker stops speaking), the render controller 709 may change the rendering mode used.

In some embodiments, the change of rendering mode may be a gradual transition. E.g. rather than simply switch between the outputs of different rendering engines as in the example of FIG. 8, a slow fade-in of one signal and fade-out of the other signal may be performed.

In some embodiments, the render controller 709 may be arranged to synchronize a change of the rendering mode for an audio component to changes in the audio content of the audio component.

Thus, in some embodiments, the rendering mode selection may be dynamic and change with changes in the content. The changes of the selection may be synchronized with transitions in the audio, such as for example with scene changes. For example, the audio processing apparatus 701 may be arranged to detect substantial and instantaneous transitions in the audio content, such as for example a change in the (low pass filtered) amplitude level or a substantial change in the (time averaged) frequency spectrum. Whenever such a change is detected, the render controller 709 may perform a re-evaluation to determine a suitable rendering mode from then on.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio processing apparatus, comprising:

a receiver circuit, wherein the receiver circuit is arranged to receive audio data and render configuration data, wherein the audio data comprises audio data for a plurality of audio components, wherein the render configuration data comprises audio transducer position data for a plurality of audio transducers;

a renderer circuit, wherein the renderer circuit is arranged to generate audio transducer signals for the plurality of audio transducers from the audio data, wherein the renderer circuit is arranged to render the plurality of audio components in accordance with selected ones of a plurality of rendering modes of the audio processing apparatus;

a render controller circuit, wherein the render controller circuit is arranged to divide the plurality of audio transducers into a first transducer subset of the plurality of audio transducers and a second transducer subset of the plurality of audio transducers, wherein the first transducer subset comprises audio transducers for which a difference between the position of the audio transducer and a predetermined position exceeds a threshold, wherein the second transducer subset comprises at least one audio transducer for which a difference between the position of the audio transducer and the predetermined position does not exceed the threshold, wherein the render controller circuit is arranged to control the renderer circuit to select a first selected rendering mode for each audio transducer of the first transducer subset, wherein the first selected rendering mode is one of a first rendering mode subset, wherein the first rendering mode subset is a portion of the plurality of rendering modes of the audio processing apparatus, wherein the render controller circuit is arranged to control the renderer circuit to select a second selected rendering mode for each audio transducer of the second transducer subset, wherein the second selected rendering mode is one of a second rendering mode subset, wherein the second rendering mode subset is a second portion of the plurality of rendering modes of the audio processing apparatus, wherein the renderer circuit is arranged to cause the first transducer subset to render a first audio component of the plurality of audio components in accordance with the first selected rendering mode, and wherein the renderer circuit is arranged to cause the second transducer subset to render the first audio component in accordance with the second selected rendering mode.

2. The audio processing apparatus of claim 1, wherein the renderer circuit is arranged to use different rendering modes for different audio components for a first audio transducer, wherein the first audio transducer is one of the plurality of audio transducers, wherein the renderer circuit is arranged to independently select rendering modes for each of the audio components for the first audio transducer.

3. The audio processing apparatus of claim 1, wherein at least two of the plurality of audio components are different audio types.

4. The audio processing apparatus of claim 3, wherein the plurality of audio components comprises at least two audio components, wherein the at least two audio components are of different audio types, wherein the at least two audio components are selected from the group consisting of audio channel components, audio object components, and audio scene components, wherein the renderer circuit is arranged to use different rendering modes for the at least two audio components.

5. The audio processing apparatus of claim 3, wherein the receiver circuit is arranged to receive audio type indication data, wherein the audio type indication data is indicative of an audio type of the first audio component, wherein the render controller circuit is arranged to select the rendering mode for the first audio component in response to the audio type indication data.

6. The audio processing apparatus of claim 1, wherein the render controller circuit is arranged to select a default rendering mode for the first audio transducer unless a difference between the position of the first audio transducer and the predetermined position exceeds a threshold.

7. The audio processing apparatus of claim 1, wherein the plurality of rendering modes of the apparatus comprises at least one rendering mode selected from the group consisting of a stereophonic rendering, a vector base amplitude panning rendering, a beamform rendering, a cross talk cancellation rendering, an ambisonic rendering, a wave field synthesis rendering and a least squares optimized rendering.

8. The audio processing apparatus of claim 1, wherein the receiver circuit is arranged to receive rendering position data for the plurality of audio components, wherein the render controller circuit is arranged to select the first selected rendering mode and the second selected rendering mode in response to the rendering position data.

9. The audio processing apparatus of claim 1, wherein the renderer circuit is arranged to use different rendering modes for different frequency bands of a third audio component of the plurality of audio components, wherein the render controller circuit is arranged to select rendering modes for different frequency bands of the third audio component.

10. The audio processing apparatus of claim 1, wherein the render controller circuit is arranged to synchronize a change of rendering for the first audio component to an audio content change in the first audio component.

11. The audio processing apparatus of claim 1, wherein the render controller circuit is arranged to select the first selected rendering mode and the second selected rendering mode in response to render configuration data, wherein the render configuration data is from the group consisting of audio transducer position data for audio transducers not in the plurality of audio transducers, listening position data, audio transducer audio rendering characteristics data for audio transducers of the plurality of audio transducers, and user rendering preferences.

12. The audio processing apparatus of claim 1 wherein the render controller circuit is arranged to select the first selected rendering mode and the second selected rendering mode in response to a quality metric generated by a perceptual model.

13. A method of audio processing, the method comprising:

receiving audio data and render configuration data using an apparatus, wherein the audio data comprises audio data for a plurality of audio components, wherein the render configuration data comprises audio transducer position data for a plurality of audio transducers;

generating audio transducer signals for the plurality of audio transducers from the audio data, wherein the generating comprises rendering the plurality of audio components in accordance with selected rendering modes of a plurality of rendering modes of the apparatus;

dividing the plurality of audio transducers into a first transducer subset a second transducer subset, wherein the first transducer subset comprises audio transducers for which a difference between the position of the audio transducer and a predetermined position exceeds a threshold, wherein the second transducer subset comprises at least one audio transducer for which a difference between the position of the audio transducer and the predetermined position does not exceed the threshold;

selecting a first selected rendering mode for each audio transducer of the first transducer subset, wherein the first selected rendering mode is one of a first rendering mode subset, wherein the first rendering mode subset is a portion of the plurality of rendering modes of the audio processing apparatus;

selecting a second selected rendering mode for each audio transducer of the second transducer subset, wherein the second selected rendering mode is one of a second rendering mode subset of the plurality of rendering modes of the apparatus, wherein the second rendering mode subset is a second portion of the plurality of rendering modes of the audio processing apparatus;

causing the first transducer subset to render a first audio component of the plurality of audio components in accordance with the first selected rendering mode; and causing the second transducer subset to render the first audio component in accordance with the second selected rendering mode.

14. The method of claim 13, wherein the generating is arranged to use different rendering modes for different audio components for a first audio transducer, wherein the first audio transducer is one of the plurality of audio transducers, wherein the generating is arranged to select rendering modes for each of the audio components for the first audio transducer.

15. The method of claim 13, wherein at least two of the plurality of audio components are different audio types.

16. The method of claim 15, wherein the at least two audio components of different audio types are selected from the group consisting of audio channel components, audio object components, and audio scene components, wherein the generating is arranged to use different rendering modes for the at least two audio components of different audio types.

17. The method of claim 15, wherein the received audio data comprises audio type indication data, wherein the audio type indication data is indicative of an audio type of the first audio component, wherein the selecting is arranged to select the rendering mode for the first audio component in response to the audio type indication data.

18. The method of claim 13, further comprising selecting a default rendering mode for the first audio transducer unless a difference between the position of the first audio transducer and the predetermined position exceeds a threshold.

19. A computer program stored on a non-transitory medium, wherein the computer program when executed on a processor performs the method as claimed in claim 13.

20. The method of claim 13, wherein the rendering modes of the apparatus are spatial rendering modes, wherein the spatial rendering modes comprise at least one rendering mode selected from the group consisting of a stereophonic rendering, a vector base amplitude panning rendering, a beamform rendering, a cross talk cancellation rendering, an ambisonic rendering, a wave field synthesis rendering and a least squares optimized rendering.

* * * * *